US006450626B2

(12) United States Patent
Ikeda et al.

(10) Patent No.: US 6,450,626 B2
(45) Date of Patent: Sep. 17, 2002

(54) INK JET HEAD, METHOD FOR PRODUCING THE SAME, AND INK JET TYPE RECORDING APPARATUS

(75) Inventors: Koji Ikeda, Hyogo; Koji Matsuo, Fukuoka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/748,770

(22) Filed: Dec. 22, 2000

(30) Foreign Application Priority Data

Dec. 24, 1999 (JP) ..... 11-366664
Dec. 24, 1999 (JP) ..... 11-366666
Dec. 24, 1999 (JP) ..... 11-366670

(51) Int. Cl.[7] ..... B41J 2/045
(52) U.S. Cl. ..... 347/70; 347/68
(58) Field of Search ..... 347/70, 68, 67, 347/74, 75; 29/890.1

(56) References Cited

U.S. PATENT DOCUMENTS

| | | | | |
|---|---|---|---|---|
| 5,202,703 A | | 4/1993 | Hoisington et al. | 347/68 |
| 5,831,650 A | * | 11/1998 | Reinten | 347/68 |
| 6,217,158 B1 | | 4/2001 | Kanaya et al. | 347/70 |

FOREIGN PATENT DOCUMENTS

| | | |
|---|---|---|
| JP | 5-500933 | 2/1993 |
| JP | 5-504740 | 7/1993 |
| JP | 05261917 A | 10/1993 |
| JP | 05-261921 | 10/1993 |
| JP | 6-91871 | 4/1994 |
| JP | 9-232644 | 9/1997 |
| JP | 09/277523 | 10/1997 |
| JP | 9-327911 | 12/1997 |
| JP | 10034924 A | 2/1998 |
| JP | 10-151739 | 6/1998 |
| JP | 11-309858 | 11/1999 |
| WO | WO 92/09111 | 5/1992 |

* cited by examiner

*Primary Examiner*—Thinh Nguyen
(74) *Attorney, Agent, or Firm*—Harness, Dickey & Pierce, P.L.C.

(57) ABSTRACT

In order to maximally improve the deformation characteristic of a piezoelectric actuator of an ink jet head so as to improve the printed image quality, the present invention newly provides expansion/contraction sections in the vicinity of a displacement section which is displaced in the thickness direction by the expansion/contraction in the planar direction of a piezoelectric layer in the piezoelectric actuator, wherein the expansion/contraction sections are expanded/contracted in the planar direction by the expansion/contraction of the piezoelectric layer in the planar direction, so that the displacement of the displacement section in the thickness direction is controlled by the expansion/contraction of the expansion/contraction section in the planar direction.

20 Claims, 11 Drawing Sheets

INK JET HEAD, METHOD FOR PRODUCING THE SAME, AND INK JET TYPE RECORDING APPARATUS

BACKGROUND OF THE INVENTION

The present invention relates to an ink jet head which uses a piezoelectric actuator to discharge ink from a pressure chamber to the outside, a method for producing the same, and an ink jet type recording apparatus incorporating the same.

Ink jet heads which use a piezoelectric actuator to discharge ink from a pressure chamber to the outside are known in the prior art. A conventional ink jet head of this type is disclosed, for example, in Japanese Laid-Open Patent Publication No. 9-232644. As illustrated in FIG. 11, the conventional ink jet head includes a pressure chamber structure member b having a plurality of pressure chambers a which are filled with ink. A common electrode d is provided substantially entirely across one surface (the upper surface in the illustrated example) of the pressure chamber structure member b along which openings c are provided respectively for the pressure chambers a. Piezoelectric layers e and separate electrodes f, which form a piezoelectric actuator together with the common electrode d, are provided at respective positions on the common electrode d corresponding to the openings c of the pressure chambers a. Upon application of a voltage between the common electrode d and one of the separate electrodes f, a corresponding one of the piezoelectric layers e expands/contracts in the planar direction (the horizontal direction in the figure). Since the expansion/contraction of a portion (i.e., the lower portion in the figure) of the piezoelectric layer e on the side of the pressure chamber a is restricted by the common electrode d, the expansion/contraction of the piezoelectric layer e in the planar direction is converted to a displacement in the thickness direction (the vertical direction in the figure). As a result of this conversion, the piezoelectric layer e is displaced in the thickness direction entailing the common electrode d and the separate electrode f, thereby changing the volume of the pressure chamber a so as to discharge the ink from the pressure chamber a to the outside.

Another type of conventional ink jet head uses a restriction plate, in addition to the common electrode d, provided on one of the surfaces of each piezoelectric layer e which are perpendicular to the thickness direction thereof for restricting the expansion/contraction of the piezoelectric layer e in the planar direction on that surface. The expansion/contraction of the piezoelectric layer e in the planar direction is converted by the restriction plate into a displacement in the thickness direction.

In recent years, the popularity of personal computers has rapidly increased. Accordingly, there is an increasing demand for improving the printed image quality as much as possible. For the above-described type of ink jet heads, it is important to improve the performance of the piezoelectric actuator in order to meet the demand.

The present invention has been made in view of such circumstances in the prior art, and has an objective of improving the deformation characteristic of a piezoelectric actuator as much as possible so as to improve the ink discharging capability and thus the printed image quality.

SUMMARY OF THE INVENTION

In order to achieve the object described above, according to the first aspect of the present invention, there is provided an ink jet head, including: a pressure chamber structure member including a plurality of pressure chambers which are filled with ink, and a plurality of openings respectively for the pressure chambers which are provided along a predetermined surface of the pressure chamber structure member; and a piezoelectric actuator provided on one surface of the pressure chamber structure member along which the openings of the pressure chambers are provided, wherein: the piezoelectric actuator includes a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction; each portion of the piezoelectric actuator which corresponds to the opening of one of the pressure chambers and which generally corresponds to a center of the opening is defined as a displacement section, wherein when an electric field for expanding/contracting the piezoelectric layer in the planar direction is applied across a portion of the piezoelectric layer corresponding to the displacement section, the expansion/contraction of the piezoelectric layer in the planar direction is converted to a displacement in the thickness direction, whereby the displacement section is displaced in the thickness direction as a result of the conversion; each portion of the piezoelectric actuator which corresponds to the opening of one of the pressure chambers and which is in a vicinity of the displacement section is defined as an expansion/contraction section, wherein when an electric field for expanding/contracting the piezoelectric layer in the planar direction is applied across a portion of the piezoelectric layer corresponding to the expansion/contraction section, the expansion/contraction section expands/contracts in the planar direction by the expansion/contraction of the piezoelectric layer in the planar direction; and the displacement of the displacement section in the thickness direction is controlled by the expansion/contraction of the expansion/contraction section in the planar direction, so that the displacement of the displacement section in the thickness direction changes a volume of the corresponding pressure chamber, thereby discharging ink from the pressure chamber to the outside.

With such a structure, upon application of an electric field in the thickness direction of the piezoelectric layer of the piezoelectric actuator, the piezoelectric layer expands/contracts according to the direction of the electric field. Specifically, when the direction of the electric field is the same as the polarization direction of the piezoelectric layer (i.e., from the negative side to the positive side), the piezoelectric layer contracts in the planar direction. When the direction of the electric field is opposite to the polarization direction of the piezoelectric layer, the piezoelectric layer expands in the planar direction.

In either case, in the displacement section (which is defined as a portion of the piezoelectric actuator which corresponds to the opening of one of the pressure chambers and which generally corresponds to the center of the opening), an electric field is applied across the piezoelectric layer in the displacement section, whereby the piezoelectric layer expands/contracts in the planar direction, and the expansion/contraction of the piezoelectric layer in the planar direction is converted into a displacement in the thickness direction, whereby the displacement section is displaced in the thickness direction. The displacement of each displacement section of the piezoelectric actuator in the thickness direction changes the volume of the corresponding pressure chamber, thereby discharging ink from the pressure chamber to the outside.

At this time, in the expansion/contraction section of the piezoelectric actuator provided in the vicinity of each displacement section, an electric field is applied across the piezoelectric layer in the expansion/contraction section, whereby the piezoelectric layer expands/contracts in the planar direction, and the expansion/contraction section is expanded/contracted in the planar direction by the expansion/contraction of the piezoelectric layer in the planar direction. By the expansion/contraction of each expansion/contraction section in the planar direction, the displacement of the corresponding displacement section in the thickness direction is controlled. For example, if the expansion/contraction section expands when the displacement section is displaced from the flat shape into a convex or concave shape, the amount of displacement of the displacement section increases by the amount of expansion of the expansion/contraction section. If expansion/contraction section contracts when the displacement section is displaced from the convex or concave shape into the flat shape, the displacement of the displacement section into the flat shape is facilitated as much as the amount of contraction of the expansion/contraction section. Thus, it is possible to improve the deformation characteristic of the piezoelectric actuator, and to improve the ink discharging capability and thus the printed image quality.

According to the second aspect of the present invention, there is provided an ink jet head as that of the first aspect of the invention, wherein in addition to the piezoelectric layer, the piezoelectric actuator further includes: a common electrode provided at least in each portion of the piezoelectric actuator which corresponds to the opening of one of the pressure chambers on one of surfaces of the piezoelectric layer which are perpendicular to the thickness direction thereof; a separate electrode provided in each displacement section on the other one of the surfaces of the piezoelectric layer which are perpendicular to the thickness direction thereof for producing an electric field of a predetermined direction between the separate electrode and the common electrode; and an auxiliary separate electrode provided in each expansion/contraction section on the same surface of the piezoelectric layer as the separate electrode for producing an electric field of a predetermined direction between the auxiliary separate electrode and the common electrode.

Thus, in each displacement section of the piezoelectric actuator, the piezoelectric layer expands/contracts in the planar direction according to the direction of the electric field which is produced between the separate electrode and the common electrode, and the expansion/contraction of the piezoelectric layer is converted into a displacement in the thickness direction. In each expansion/contraction section, the piezoelectric layer expands/contracts in the planar direction according to the direction of the electric field which is produced between the auxiliary separate electrode and the common electrode. As a result, the function of the first aspect of the invention is realized.

According to the third aspect of the present invention, there is provided an ink jet head as that of the second aspect of the invention, wherein the common electrode is provided substantially entirely across one surface of the pressure chamber structure member along which the openings of the pressure chambers are provided.

According to the fourth aspect of the present invention, there is provided an ink jet head as that of the second aspect of the invention, wherein the common electrode is provided only in each portion of the piezoelectric actuator which corresponds to the opening of one of the pressure chambers.

According to these aspects of the invention, the function of the second aspect of the invention is realized in a desirable manner. Particularly, according to the third aspect of the invention, it is not necessary to divide the common electrode into portions and to provide wirings, or the like, for connecting the common electrode portions together, thereby simplifying the structure.

According to the fifth aspect of the present invention, there is provided an ink jet head as that of the second aspect of the invention, wherein the auxiliary separate electrode is provided only in an area within which the piezoelectric layer can expand/contract in the planar direction.

Thus, the auxiliary separate electrode is not provided in an area where the piezoelectric layer cannot expand/contract, e.g., the area on the pressure chamber structure member excluding the openings, thereby avoiding provision of the auxiliary separate electrode in positions where the auxiliary separate electrode is not necessary. Therefore, the advantageous effects of the second aspect of the invention can be obtained more efficiently.

According to the sixth aspect of the present invention, there is provided an ink jet head as that of the second aspect of the invention, wherein when a voltage is applied between the common electrode and the separate electrode in one displacement section, the voltage producing an electric field of such a direction as to contract the piezoelectric layer in the displacement section, a voltage is applied between the common electrode and the auxiliary separate electrode in each expansion/contraction section corresponding to the displacement section, the voltage producing an electric field of such a direction as to expand the piezoelectric layer in the expansion/contraction section.

Thus, a voltage is applied between the common electrode and the separate electrode in each displacement section so as to produce an electric field of such a direction as to contract the piezoelectric layer in the displacement section. As a result, the piezoelectric layer in the displacement section contracts in the planar direction. At this time, a voltage is applied between the common electrode and the auxiliary separate electrode in the expansion/contraction section corresponding to the displacement section so as to produce an electric field of such a direction as to expand the piezoelectric layer in the expansion/contraction section. Thus, an electric field of the opposite direction to that applied across the displacement section is produced in the expansion/contraction section. Accordingly, the piezoelectric layer in the expansion/contraction section expands as opposed to the displacement section. Thus, the expansion/contraction section expands in the planar direction. As a result, the contraction of the piezoelectric layer in the corresponding displacement section is facilitated as much as the expansion of the expansion/contraction section.

According to the seventh aspect of the present invention, there is provided an ink jet head as that of the second aspect of the invention, wherein when a voltage is applied between the common electrode and the separate electrode in one displacement section, the voltage producing an electric field of such a direction as to expand the piezoelectric layer in the displacement section, a voltage is applied between the common electrode and the auxiliary separate electrode in each expansion/contraction section corresponding to the displacement section, the voltage producing an electric field of such a direction as to expand the piezoelectric layer in the expansion/contraction section.

Thus, a voltage is applied between the common electrode and the separate electrode in each displacement section and between the common electrode and the auxiliary separate electrode in the expansion/contraction section corresponding to the displacement section so as to produce an electric field of such a direction as to expand the piezoelectric layer both in the displacement section and the expansion/contraction section. As a result, the expansion of the expansion/contraction section is added to the expansion of the displacement section itself, whereby the displacement in the thickness direction of the piezoelectric layer in the displacement section is greater than that provided by only the expansion of the displacement section itself.

According to the eighth aspect of the present invention, there is provided an ink jet head as that of the seventh aspect of the invention, wherein the auxiliary separate electrode in each expansion/contraction section is provided to be integral with the separate electrode in the corresponding displacement section.

Thus, if the direction of the electric field produced between the common electrode and the separate electrode in each displacement section is the same as the direction of the electric field produced between the common electrode and the auxiliary separate electrode in the corresponding expansion/contraction section, as in the seventh aspect of the invention, the separate electrode and the auxiliary separate electrode are provided with the same potential direction (positive/negative) with respect to the common electrode. Since the auxiliary separate electrode is integral with the separate electrode, the same voltage application means can be used as means for applying a voltage between the common electrode and the separate electrode in each displacement section and also as means for applying a voltage between the common electrode and the auxiliary separate electrode in each expansion/contraction section. Therefore, the advantageous effects of the seventh aspect of the invention can be obtained more efficiently.

According to the ninth aspect of the present invention, there is provided an ink jet head, including: a pressure chamber structure member including a plurality of pressure chambers which are filled with ink, and a plurality of openings respectively for the pressure chambers which are provided along a predetermined surface of the pressure chamber structure member; and a piezoelectric actuator provided on one surface of the pressure chamber structure member along which the openings of the pressure chambers are provided, wherein: the piezoelectric actuator includes: a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction; a common electrode provided on one of surfaces of the piezoelectric layer which are perpendicular to the thickness direction thereof; and a separate electrode provided on the other one of the surfaces of the piezoelectric layer which are perpendicular to the thickness direction thereof for producing the electric field of a predetermined direction between the separate electrode and the common electrode; a restriction plate for restricting expansion/contraction in the planar direction of a portion of the piezoelectric layer on one side thereof which is closer to the pressure chamber structure member is provided in each portion of the piezoelectric actuator which corresponds to the opening of one of the pressure chambers on one surface of the piezoelectric actuator which is closer to the pressure chamber structure member; and the expansion/contraction of the piezoelectric layer in the planar direction is converted by the restriction plate into a displacement in the thickness direction thereof to displace in the thickness direction a portion of the piezoelectric actuator which corresponds to the opening of the pressure chamber so as to change a volume of the corresponding pressure chamber, thereby discharging ink from the pressure chamber to the outside.

According to this aspect of the invention, the piezoelectric layer of the piezoelectric actuator is provided substantially entirely across the surface of the pressure chamber structure member. Therefore, the electrical insulation between the common electrode and the separate electrode along the thickness direction is reliably ensured by the piezoelectric layer. As a result, an electrical discharge between these electrodes is less likely to occur as compared to a case where the piezoelectric layer is provided only in a portion of the piezoelectric actuator corresponding to the opening of each of the pressure chambers. Thus, by providing the piezoelectric layer substantially entirely across the surface of the pressure chamber structure member, it is possible to prevent the deformation characteristic of the piezoelectric actuator from deteriorating due to an electrical discharge, or the like, between the common electrode and the separate electrode. Moreover, when the piezoelectric layer is provided substantially entirely across the surface of the pressure chamber structure member, the portion of the piezoelectric actuator for displaceably supporting a portion of the piezoelectric layer which is displaced in the thickness direction (the portion of the piezoelectric actuator surrounding the displacement section) is formed by the piezoelectric layer in addition to the common electrode. Therefore, the thickness of such a portion is increased by the thickness of the piezoelectric layer, and the piezoelectric actuator may become less flexible, thereby deteriorating the deformation characteristic thereof. However, according to this aspect of the invention, the restriction plate is provided in each portion of the piezoelectric actuator which corresponds to the opening of one of the pressure chambers. Therefore, the restriction plate does not need to be provided in the support section. Moreover, the common electrode does not need to function as a restriction plate. Accordingly, the common electrode can be made more flexible. Thus, the flexibility of the support section is not reduced, thereby suppressing the possible deterioration in the deformation characteristic of the piezoelectric actuator. Therefore, as in the first aspect of the invention, it is possible to improve the deformation characteristic of the piezoelectric actuator as much as possible, and to improve the ink discharging capability and thus the printed image quality.

According to the tenth aspect of the present invention, there is provided an ink jet head as that of the ninth aspect of the invention, wherein the separate electrode is provided on the surface of the piezoelectric layer which is away from the pressure chamber structure member.

Thus, the common electrode is located on the side of the piezoelectric layer which is closer to the pressure chamber structure member, and can be provided substantially entirely across the surface of the pressure chamber structure member, thereby facilitating and making more reliable the support for the portion which deforms.

According to the eleventh aspect of the present invention, there is provided an ink jet head as that of the ninth aspect of the invention, wherein an electrically insulative layer is provided substantially entirely across the surface of the piezoelectric actuator which is closer to the pressure chamber structure member; and each restriction plate is secured to the piezoelectric actuator via the electrically insulative layer.

With no additional measure taken, the electrode on the side of the piezoelectric layer which is closer to the pressure chamber structure member contacts the ink contained in the pressure chamber. Ink used in an ink jet head is typically water-soluble. Therefore, with no additional measure taken, the potential of the electrode is changed to the ground side via the ink. For example, if the electrode is the separate electrode of the present invention, the potentials of all of such separate electrodes will transition to the same potential via the ink. Even when the electrode is the common electrode of the present invention, if a positive or negative potential is applied to the common electrode, the potential of the common electrode is reduced or increased toward the ground side potential. However, according to this aspect of the invention, the electrode on the side of the piezoelectric layer which is closer to the pressure chamber structure member is electrically insulated by the electrically insulative layer from the ink contained in the ink pressure chamber, thus avoiding such a problem. Moreover, when the separate electrode is located on the side of the piezoelectric layer closer to the pressure chamber structure member, it is possible to prevent the piezoelectric layer from deteriorating due to a direct contact with the ink contained in the pressure chamber.

According to the twelfth aspect of the present invention, there is provided an ink jet head as that of the ninth aspect of the invention, wherein: the pressure chamber structure member and the piezoelectric actuator are bonded together via an intermediate structure member which is provided to be integral with the piezoelectric actuator; and the intermediate structure member is made of the same material as the restriction plate.

When the pressure chamber structure member and the piezoelectric actuator are bonded together via the intermediate structure member which is provided to be integral with the piezoelectric actuator, the production process would require a separate step for providing the intermediate structure member. However, according to this aspect of the invention, the intermediate structure member is made of the same material as the restriction plate. Therefore, when the restriction plate having a predetermined shape is provided from a restriction plate layer as will be described below as the sixteenth aspect of the invention, the intermediate structure member can be provided from the same restriction plate layer and simultaneously with the restriction plate. As a result, unlike when the intermediate structure member is made of a material different from that of the restriction plate, there is no need for a step of providing a separate intermediate structure member layer or a step of providing the intermediate structure member from the intermediate structure member layer. Thus, it is possible to suppress the possible increase in the number of steps for producing the ink jet head.

According to the thirteenth aspect of the present invention, there is provided an ink jet head as that of the ninth aspect of the invention, wherein the pressure chamber structure member and the piezoelectric actuator are bonded together via an intermediate structure member which is provided to be integral with the piezoelectric actuator by means of an electro-deposition resin; and the intermediate structure member is made of an electrically conductive material and functions as an electro-deposition electrode for electro-deposition of the electro-deposition resin onto the intermediate structure member.

When the pressure chamber structure member and the piezoelectric actuator are bonded together via the intermediate structure member by means of the electro-deposition resin, it is necessary during the production process to electro-deposit the electro-deposition resin onto one of the junction plane between the pressure chamber structure member and the intermediate structure member and the junction plane between the piezoelectric actuator and the intermediate structure member. This requires a separate electrode for electro-deposition to be provided on the side which is to be subjected to electro-deposition. However, according to this aspect of the invention, the intermediate structure member is made of an electrically conductive material, whereby the electro-deposition process can be performed by using the intermediate structure member as an electro-deposition electrode, thus eliminating the need for providing a separate electro-deposition electrode.

According to the fourteenth aspect of the present invention, there is provided a method for producing an ink jet head, the ink jet head including: a piezoelectric actuator including a piezoelectric layer which expands/contracts in a planar direction perpendicular to a thickness direction according to a direction of an electric field applied in the thickness direction, wherein the expansion/contraction of the piezoelectric layer in the planar direction is converted into a displacement in the thickness direction by a restriction plate for restricting the expansion/contraction on one of surfaces of the piezoelectric layer which are perpendicular to the thickness direction, thereby discharging ink from the pressure chamber to the outside.

According to this aspect of the invention, the method includes the steps of: providing a piezoelectric actuator on a substrate; providing a restriction plate layer on the piezoelectric actuator so as to substantially entirely cover the surface of the piezoelectric actuator; patterning the restriction plate layer into a predetermined pattern so as to provide a plurality of restriction plates from the restriction plate layer, thereby providing an intermediate product which includes the piezoelectric actuator and the restriction plates being provided on the substrate; bonding the intermediate product to a pressure chamber structure member which includes a plurality of pressure chambers so that the restriction plates are located on the side of the intermediate product which is closer to the pressure chamber structure member and the restriction plates respectively correspond to the pressure chambers; and removing the substrate from the intermediate product on the pressure chamber structure member.

According to this aspect of the invention, in the production of an ink jet head, the piezoelectric actuator bonded to the pressure chamber structure member is provided on the substrate along with the restriction plate. Specifically, after the piezoelectric actuator is provided on the substrate, the restriction plate layer is provided on the piezoelectric actuator so as to substantially entirely cover the surface of the piezoelectric actuator. Then, a plurality of restriction plates are provided from the restriction plate layer. Thus, an intermediate product is obtained which includes the piezoelectric actuator and the restriction plates being provided on the substrate. The intermediate product is bonded to the pressure chamber structure member so that the restriction plates are on the side closer to the pressure chamber structure member. Then, the substrate is removed from the intermediate product on the pressure chamber structure member. Thus, the ink jet head according to the ninth aspect of the invention can be easily obtained.

According to the fifteenth aspect of the present invention, there is provided a method for producing an ink jet head as that of the fourteenth aspect of the invention, wherein after providing the piezoelectric actuator on the substrate, an electrically insulative layer is provided on the piezoelectric actuator so as to substantially entirely cover the surface of the piezoelectric actuator; and after providing the electrically insulative layer, the restriction plate layer is provided on the electrically insulative layer.

Thus, before providing the restriction plate layer on the piezoelectric actuator on the substrate, the electrically insulative layer is provided on the piezoelectric actuator, and the restriction plate layer is provided on the electrically insulative layer. Therefore, the ink jet head according to the eleventh aspect of the invention can be easily obtained.

According to the sixteenth aspect of the present invention, there is provided a method for producing an ink jet head as that of the fourteenth aspect of the invention, wherein an intermediate structure member is provided from the restriction plate layer simultaneously while providing the restriction plates from the restriction plate layer; and after providing the intermediate structure member, the intermediate product and the pressure chamber structure member are bonded together via the intermediate structure member.

Thus, in the case where the pressure chamber structure member and the piezoelectric actuator are bonded together via the intermediate structure member which is provided to be integral with the piezoelectric actuator, when the restriction plates are provided on the piezoelectric actuator from the restriction plate layer, the intermediate structure member is simultaneously provided also from the restriction plate layer. Therefore, the ink jet head according to the twelfth aspect of the invention can be easily obtained.

According to the seventeenth aspect of the present invention, there is provided a method for producing an ink jet head as that of the sixteenth aspect of the invention, wherein when providing the restriction plate layer, an electrically conductive material is used as a material of the restriction plate layer; after providing the restriction plates and the intermediate structure member from the restriction plate layer, an electro-deposition resin is electro-deposited onto the intermediate structure member by using the intermediate structure member as an electro-deposition electrode; and after the electro-deposition of the electro-deposition resin, the intermediate product and the pressure chamber structure member are bonded together by the electro-deposition resin on the intermediate structure member.

Thus, in the case where the pressure chamber structure member and the intermediate product are bonded together by the electro-deposition resin, an electrically conductive material is used as the material of the restriction plate layer. After the restriction plates and the intermediate structure member are provided simultaneously from the restriction plate layer, the electro-deposition resin is electro-deposited onto the intermediate structure member by using the intermediate structure member as an electro-deposition electrode. Therefore, the ink jet head according to the thirteenth aspect of the invention can be easily obtained.

According to the eighteenth aspect of the present invention, there is provided a method for producing an ink jet head, the ink jet head including: a piezoelectric layer which expands/contracts in a planar direction perpendicular to a thickness direction according to a direction of an electric field applied in the thickness direction, wherein the expansion/contraction of the piezoelectric layer in the planar direction is converted into a displacement in the thickness direction, thereby discharging ink from the pressure chamber to the outside, the method including the steps of: providing a common electrode on a substrate substantially entirely across the surface of the substrate; providing a piezoelectric layer on the common electrode substantially entirely across the surface of the common electrode; providing a separate electrode layer on the piezoelectric layer substantially entirely across the surface of the piezoelectric layer; patterning the separate electrode layer into a predetermined pattern so as to provide a plurality of separate electrodes from the separate electrode layer; and providing a plurality of pressure chambers in the substrate so that the pressure chambers respectively correspond to the separate electrodes.

Thus, the common electrode, the piezoelectric layer and the separate electrode layer are provided in this order on the substrate substantially entirely across the surface of the substrate, after which a plurality of separate electrodes are provided from the separate electrode layer. After the plurality of separate electrodes are provided, a plurality of pressure chambers are provided on the substrate so as to respectively correspond to the separate electrodes. As a result, the substrate becomes a pressure chamber structure member, and the common electrode and the piezoelectric layer are provided substantially entirely across the surface of the pressure chamber structure member. With such a production method, the piezoelectric layer can be provided as a thin film by using a sputtering method, whereby it is possible to stabilize the thickness and also to improve the stress resisting property thereof. As a result, it is possible to easily and stably produce a piezoelectric actuator which has a high flexibility and a high mechanical strength. Moreover, as in the ninth aspect of the invention, it is possible to suppress the possible electrical discharge between the common electrode and the separate electrode. Thus, it is possible to improve the deformation characteristic of the piezoelectric actuator as much as possible, and to improve the ink discharging capability and thus the printed image quality.

According to the nineteenth aspect of the present invention, there is provided an ink jet type recording apparatus for performing a recording operation by discharging ink from an ink jet head onto a recording medium, wherein: the ink jet head includes: a pressure chamber structure member, the pressure chamber structure member including a plurality of pressure chambers which are filled with ink and a plurality of openings respectively for the pressure chambers which are provided along a predetermined surface of the pressure chamber structure member; and a piezoelectric actuator provided on one surface of the pressure chamber structure member along which the openings of the pressure chambers are provided; the piezoelectric actuator includes a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction; each portion of the piezoelectric actuator which corresponds to the opening of one of the pressure chambers and which generally corresponds to a center of the opening is defined as a displacement section, wherein when an electric field for expanding/contracting the piezoelectric layer in the planar direction is applied across a portion of the piezoelectric layer corresponding to the displacement section, the expansion/contraction of the piezoelectric layer in the planar direction is converted to a displacement in the thickness direction, whereby the displacement section is displaced in the thickness direction as a result of the conversion; each portion of the piezoelectric actuator which corresponds to the opening of one of the pressure chambers and which is in a vicinity of the displacement section is defined as an expansion/contraction section, wherein when an electric field for expanding/contracting the piezoelectric layer in the planar direction is applied across a portion of the piezoelectric layer corresponding to the expansion/contraction section, the expansion/contraction section expands/contracts in the planar direction by the expansion/contraction of the piezoelectric layer in the planar direction; and the ink jet head is configured so that the displacement of the displacement section in the thickness direction is controlled by the expansion/contraction of the expansion/contraction section in the planar direction, so that the displacement of the displacement section in the thickness direction changes a volume of the corresponding pressure chamber, thereby discharging ink from the pressure chamber onto the recording medium.

According to this aspect of the invention, advantageous effects as those of the first aspect of the invention can be obtained.

According to the twentieth aspect of the present invention, there is provided an ink jet type recording apparatus for performing a recording operation by discharging ink from an ink jet head onto a recording medium, wherein: the ink jet head includes: a pressure chamber structure member, the pressure chamber structure member including a plurality of pressure chambers which are filled with ink and a plurality of openings respectively for the pressure chambers which are provided along a predetermined surface of the pressure chamber structure member; and a piezoelectric actuator provided on one surface of the pressure chamber structure member along which the openings of the pressure chambers are provided; the piezoelectric actuator includes: a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction; a common electrode provided on one of surfaces of the piezoelectric layer which are perpendicular to the thickness direction thereof; and a separate electrode provided on the other one of the surfaces of the piezoelectric layer which are perpendicular to the thickness direction thereof for producing the electric field of a predetermined direction between the separate electrode and the common electrode; a restriction plate for restricting expansion/contraction in the planar direction of a portion of the piezoelectric layer on one side thereof which is closer to the pressure chamber structure member is provided in each portion of the piezoelectric actuator which corresponds to the opening of one of the pressure chambers on one surface of the piezoelectric actuator which is closer to the pressure chamber structure member; and the ink jet head is configured so that the expansion/contraction of the piezoelectric layer in the planar direction is converted by the restriction plate into a displacement in the thickness direction thereof to displace in the thickness direction a portion of the piezoelectric actuator which corresponds to the opening of the pressure chamber so as to change a volume of the corresponding pressure chamber, thereby discharging ink from the pressure chamber onto the recording medium.

Thus, advantageous effects as those of the ninth aspect of the invention can be obtained.

DETAILED DESCRIPTION OF THE INVENTION

Embodiments of the present invention will now be described with reference to the figures.

Embodiment 1

Figure 1:
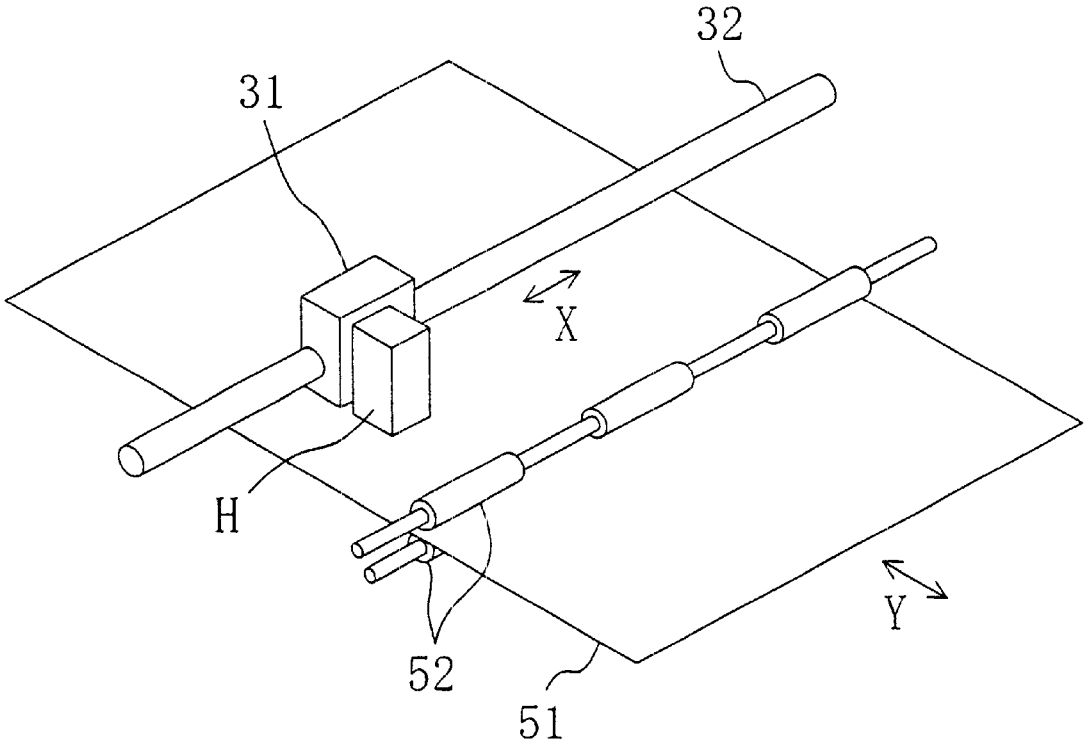
FIG. 1 is a perspective view generally illustrating an ink jet type recording apparatus according to Embodiment 1 of the present invention.

FIG. 1 generally illustrates an ink jet type recording apparatus according to Embodiment 1 of the present invention. The ink jet type recording apparatus includes an ink jet head H for discharging ink onto recording paper 51 as a recording medium in a manner which will be described later. The ink jet head H is securely supported by a carriage 31. The carriage 31 is provided with a carriage motor (not shown). The ink jet head H and the carriage 31 are reciprocated along the primary scanning direction (the X direction as shown in FIG. 1) while being guided by a carriage shaft 32 which extends in the primary scanning direction. The carriage 31, the carriage shaft 32 and the carriage motor together form relative movement means for relatively moving the ink jet head H and the recording paper 51 with respect to each other along the primary scanning direction.

The recording paper 51 is sandwiched between two carrier rollers 52 which are rotated by a carrier motor (not shown), and is carried by the carrier motor and the carrier rollers 52 under the ink jet head H along the secondary scanning direction (the Y direction as shown in FIG. 1) which is perpendicular to the primary scanning direction. The carrier motor and the carrier rollers 52 together form relative movement means for relatively moving the ink jet head H and the recording paper 51 with respect to each other along the secondary scanning direction.

Figure 2:
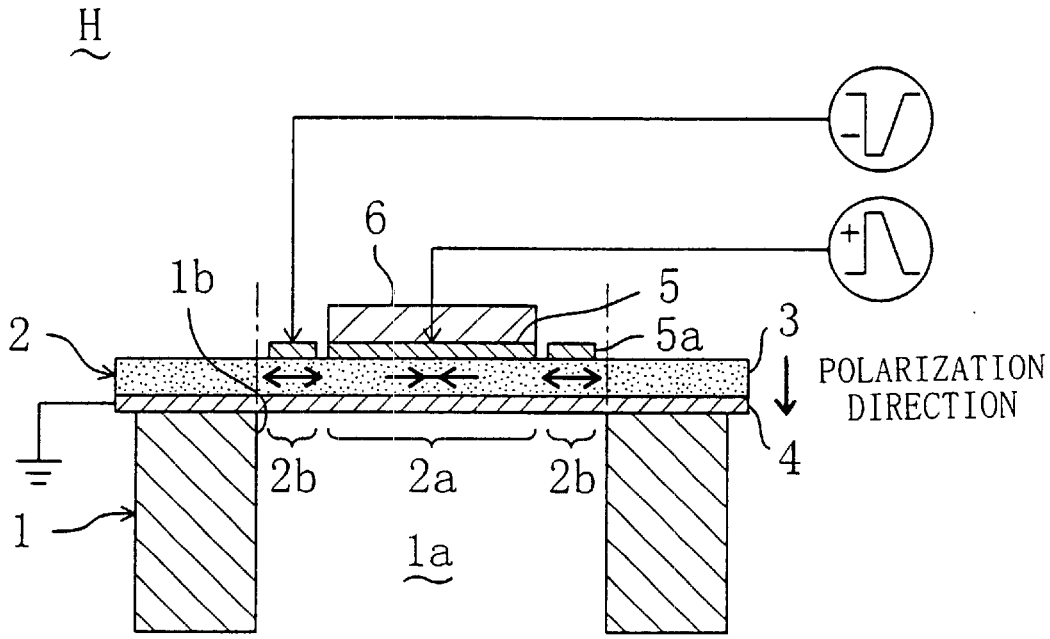
FIG. 2 is a cross-sectional view schematically illustrating an important part of an ink jet head according to Embodiment 1 of the present invention.

The ink jet head H includes a plate-shaped pressure chamber structure member 1 as schematically illustrated in FIG. 2. The pressure chamber structure member 1 is provided with a plurality of pressure chambers 1*a* (only one is shown in FIG. 2) therein. Each pressure chamber 1*a* is filled with ink via an ink supply path (not shown). Each pressure chamber 1*a* has a rectangular cross section and, in the illustrated example, the pressure chamber 1*a* is longer in the horizontal direction in the figure. Nozzles (not shown) through which ink is discharged from the respective pressure chambers 1*a* are provided on one of the surfaces (the lower surface in the illustrated example) of the pressure chamber structure member 1 perpendicular to the thickness direction thereof (the vertical direction). The pressure chambers 1*a* include respective openings 1*b* on the other one of the surfaces (the upper surface in the illustrated example) of the pressure chamber structure member 1 perpendicular to the thickness direction thereof. Each opening 1*b* has a rectangular shape which is longer in the horizontal direction in FIG. 2 in accordance with the shape of the pressure chamber 1*a*.

A piezoelectric actuator 2 is provided substantially entirely across one surface (the upper surface in the illustrated example) of the pressure chamber structure member 1 along which the openings 1*b* of the pressure chambers 1*a* are provided so that the piezoelectric actuator 2 covers the openings 1*b*. The piezoelectric actuator 2 includes a piezoelectric layer 3 made of a material such as lead zirconate titanate (PZT), a common electrode 4 provided on one of the surfaces of the piezoelectric layer 3 perpendicular to the thickness direction thereof (the vertical direction), a plurality of separate electrodes 5 provided on the other one of the surfaces of the piezoelectric layer 3 perpendicular to the thickness direction thereof, and a plurality of restriction plates 6 provided on one surface (the upper surface in the illustrated example) of the separate electrodes 5 which is away from the piezoelectric layer 3.

Specifically, the piezoelectric layer 3 is provided substantially entirely across one surface (the upper surface in the illustrated example) of the pressure chamber structure member 1 along which the openings 1*b* of the pressure chambers 1*a* are provided. The piezoelectric layer 3 is polarized in the thickness direction thereof as indicated by an arrow in FIG. 2 so that the piezoelectric layer 3 has its positive pole on the side thereof which is closer to the pressure chamber structure member 1. Therefore, the piezoelectric layer 3 contracts in the planar direction upon application of an electric field along the thickness direction such that the negative side of the electric field corresponds to the positive pole of the piezoelectric layer 3, and the piezoelectric layer 3 expands in the planar direction upon application of an electric field of the opposite direction.

The common electrode 4 is provided on one side (the lower side in the illustrated example) of the piezoelectric layer 3 which is closer to the pressure chamber structure member 1. As the piezoelectric layer 3, the common electrode 4 is provided substantially entirely across one surface (the upper surface in the illustrated example) of the pressure chamber structure member 1 along which the openings 1*b* of the pressure chambers 1*a* are provided. The common electrode 4 is grounded.

The separate electrodes 5 are provided on the other side (the upper side in the illustrated example) of the piezoelectric layer 3 which is away from the pressure chamber structure member 1. The separate electrodes 5 are provided separately from one another each in a portion of the piezoelectric actuator 2 which corresponds to the opening 1*b* of one of the pressure chambers 1*a*. Each separate electrode 5 extends over generally the center of the corresponding opening 1*b* and has a shape which is longer in the horizontal direction in FIG. 2 in accordance with the shape of the opening 1*b*. Each separate electrode 5 has a positive potential when driving the piezoelectric layer 3.

As the separate electrodes 5, the restriction plates 6 are provided separately from one another in portions of the piezoelectric actuator 2 which respectively correspond to the openings 1*b* of the pressure chambers 1*a*. Each restriction plate 6 is provided on the corresponding separate electrode 5 and has the same size and the same shape as those of the separate electrode 5 in a plan view.

Each portion of the piezoelectric actuator 2 which corresponds to the opening 1*b* of one of the pressure chambers 1*a* and which generally corresponds to the center of the opening 1*b* is defined as a displacement section 2*a*. When an electric field for expanding/contracting the piezoelectric layer 3 in the planar direction is applied across a portion of the piezoelectric layer 3 corresponding to the displacement section 2*a*, the expansion/contraction of the piezoelectric layer 3 in the planar direction is converted to a displacement in the thickness direction. As a result of the conversion, the displacement section 2*a* is displaced in the thickness direction. The displacement of the displacement section 2*a* in the thickness direction changes the volume of the corresponding pressure chamber 1*a,* thereby discharging ink from the pressure chamber 1*a* to the outside through the nozzle. Each portion of the piezoelectric actuator 2 in the vicinity of the displacement section 2*a* is defined as an expansion/contraction section 2*b*. When an electric field for expanding/contracting the piezoelectric layer 3 in the planar direction is applied across a portion of the piezoelectric layer 3 corresponding to the expansion/contraction section 2*b,* the expansion/contraction section 2*b* expands/contracts in the planar direction by the expansion/contraction of the piezoelectric layer 3 in the planar direction.

Specifically, each displacement section 2*a* includes the piezoelectric layer 3, the common electrode 4, the separate electrode 5 and the restriction plate 6. In the presence of an applied voltage between the common electrode 4 and the separate electrode 5, an electric field is applied across the piezoelectric layer 3 between the electrodes 4 and 5 such as to expand/contract the piezoelectric layer 3. However, the expansion/contraction in the planar direction on the side of the piezoelectric layer 3 which is away from the pressure chamber structure member 1 is restricted by the restriction plate 6. As a result, the piezoelectric layer 3 is displaced in the thickness direction.

Auxiliary separate electrodes 5*a* are provided on the same side of the piezoelectric layer 3 as the separate electrodes 5 respectively for the expansion/contraction sections 2*b*. Each of the auxiliary separate electrodes 5*a* is provided for producing an electric field in a predetermined direction between the common electrode 4 and the auxiliary separate electrode 5*a*. Thus, each expansion/contraction section 2*b* includes the piezoelectric layer 3, the common electrode 4 and the auxiliary separate electrode 5*a*. In the presence of an applied voltage between the common electrode 4 and the auxiliary separate electrode 5*a,* an electric field is applied across the piezoelectric layer 3 between the electrodes 4 and 5*a* such as to contract the piezoelectric layer 3.

A pair of auxiliary separate electrodes 5*a* are provided for each separate electrode 5 respectively on opposite sides of the separate electrode 5 along the longitudinal direction thereof (the horizontal direction in FIG. 2). Each pair of auxiliary separate electrodes 5*a* are electrically connected to each other. As indicated by one-dot chain lines in FIG. 2, each pair of auxiliary separate electrodes 5*a* are located within a planar area defined by the boundary of the corresponding opening 1*b* so as to be on the side of the opening 1*b* with respect to the boundary and so as not to extend out of the opening 1*b* beyond the boundary. Thus, each auxiliary separate electrode 5*a* is provided only in an area within which the piezoelectric layer 3 can expand/contract in the planar direction, and is not located on any portion of the pressure chamber structure member 1 which is outside of the opening 1*b*.

In each displacement section 2*a*, in the presence of an applied voltage which applies an electric field in such a direction as to contract the piezoelectric layer 3 between the electrodes 4 and 5, another voltage is applied between the common electrode 4 and the auxiliary separate electrode 5*a* which applies an electric field in such a direction as to expand the piezoelectric layer 3 between the electrodes 4 and 5*a*. In other words, with respect to the grounded common electrode 4, when the separate electrode 5 in the displacement section 2*a* has a positive potential, each of the auxiliary separate electrodes 5*a* in the corresponding expansion/contraction sections 2*b* has a negative potential.

The operation of the ink jet head H having such a structure will now be described.

In each displacement section 2*a* of the piezoelectric actuator 2 of the ink jet head H, in the presence of a pulse voltage applied between the common electrode 4 and the separate electrode 5 such that the separate electrode 5 has a potential higher than that of the common electrode 4, an electric field of the same direction as the polarization direction of the piezoelectric layer 3 is produced between the common electrode 4 and the separate electrode 5 at the rising edge of the pulse voltage, thereby contracting the piezoelectric layer 3 in the planar direction. However, the contraction on the side of the piezoelectric layer 3 which is closer to the restriction plate 6 is restricted by the restriction plate 6. As a result, the piezoelectric layer 3 is deformed into a convex shape protruding in the thickness direction toward the restriction plate 6. As a result of the displacement of the piezoelectric layer 3 in the thickness direction, the displacement section 2*a* is displaced in the thickness direction.

At this time, in the expansion/contraction sections 2*b* corresponding to the displacement section 2*a*, a pulse voltage is applied between the common electrode 4 and the auxiliary separate electrodes 5*a* such that the auxiliary separate electrodes 5*a* have a potential lower than that of the common electrode 4, as opposed to the displacement section 2*a*. In other words, an electric field of the opposite direction to the polarization direction of the piezoelectric layer 3 is produced between the common electrode 4 and the auxiliary separate electrodes 5*a* at the falling edge of the pulse voltage. As a result, the piezoelectric layer 3 expands in the planar direction, thereby expanding the expansion/contraction sections 2*b* in the planar direction.

Thus, the expansion of the expansion/contraction sections 2*b* in the planar direction facilitates the contraction in the planar direction of the piezoelectric layer 3 in the corresponding displacement section 2*a*. As a result, the amount of displacement of the displacement section 2*a* in the thickness direction is increased.

At the falling edge of the pulse voltage applied between the common electrode 4 and the separate electrode 5, the displacement section 2*a* returns to the original flat shape. At this time, the pulse voltage applied between the common electrode 4 and the auxiliary separate electrodes 5*a* rises, thereby contracting the expansion/contraction sections 2*b*. As a result, the returning of the displacement section 2*a* to the flat shape is facilitated.

According to the displacement of the displacement section 2*a* in the thickness direction, the volume of the corresponding pressure chamber 1*a* is once increased and then reduced to the original volume. The increase in the volume of the pressure chamber 1*a* fills the pressure chamber 1*a* with ink, and the reduction in the volume of the pressure chamber 1*a* discharges the ink from the pressure chamber 1*a* onto the recording paper 51 through the nozzle.

The application of the respective pulse voltages between the common electrode 4 and the separate electrode 5 and between the common electrode 4 and the auxiliary separate electrodes 5*a* is repeated with a predetermined period while the ink jet head H and the carriage 31 are moved along the primary scanning direction over the recording paper 51 from one end to the other at a substantially constant speed (note that voltages are not applied when the ink jet head H is at a position where ink is not supposed to be jetted onto the recording paper 51). Thus, ink is jetted onto predetermined positions on the recording paper 51. After the completion of recording for a single scanning operation, the recording paper 51 is carried by a predetermined amount along the secondary scanning direction by means of the carrier motor and the carrier rollers 52. Then, recording for another scanning operation is performed by discharging ink droplets while moving the ink jet head H and the carriage 31 along the primary scanning direction. By repeating such an operation, an intended image is formed over the entire recording paper 51.

Thus, in Embodiment 1 as described above, the piezoelectric actuator 2 includes the piezoelectric layer 3, the common electrode 4 and the separate electrodes 5. The piezoelectric actuator 2 is further provided with the restriction plates 6. Each of the restriction plates 6 is provided in a portion of the piezoelectric actuator 2 which corresponds to the opening 1*b* of one of the pressure chambers 1*a* and which generally corresponds to the center of the opening 1*b*, thereby providing the displacement section 2*a*. Moreover, a pair of auxiliary separate electrodes 5*a* are provided in the vicinity of each displacement section 2*a*, thereby providing a pair of expansion/contraction sections 2*b*. Upon displacement of the displacement section 2*a* in the thickness direction, the corresponding pair of expansion/contraction sections 2*b* expand in the planar direction. Thus, for the opening 1*b* of each pressure chamber 1*a*, the amount of displacement of the displacement section 2*a* of the piezoelectric actuator 2 in the thickness direction can be increased. Moreover, the returning of the displacement section 2*a* to the original shape can be facilitated. As a result, it is possible to improve the deformation characteristic of the piezoelectric actuator 2, and to improve the ink discharging capability and thus the printed image quality.

Embodiment 2

Figure 3:
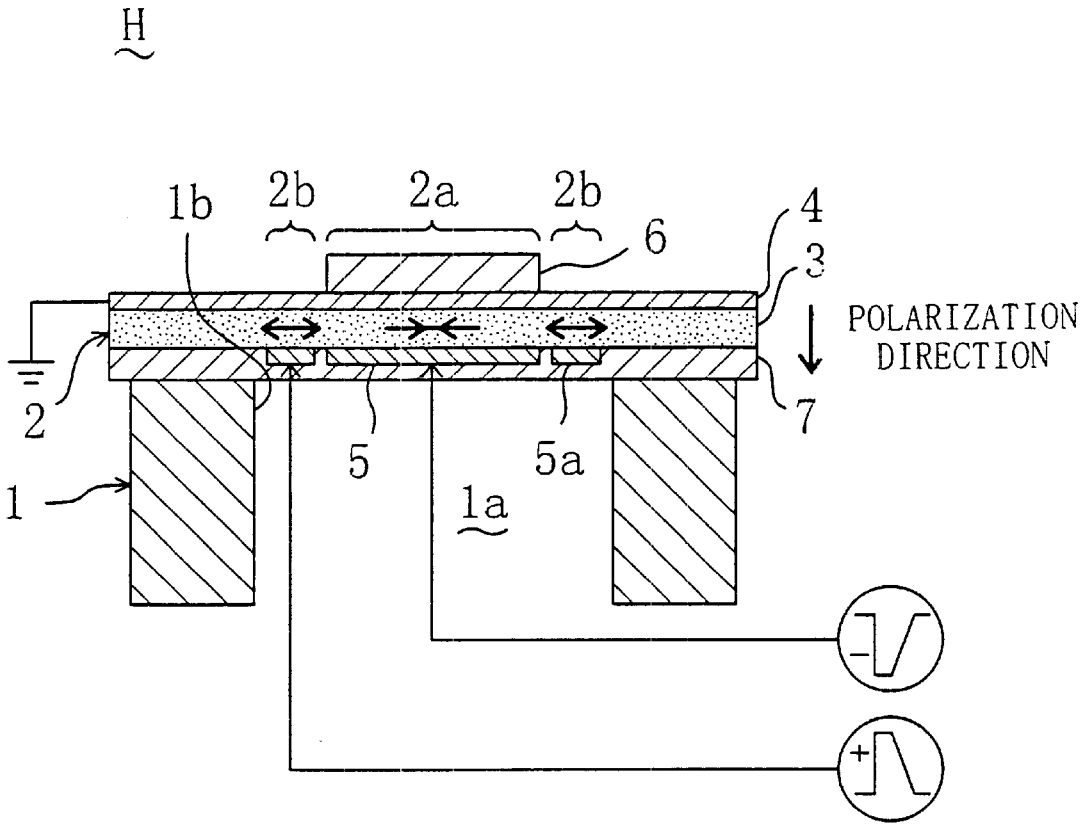
FIG. 3 is a cross-sectional view schematically illustrating an important part of an ink jet head according to Embodiment 2 of the present invention.

FIG. 3 schematically illustrates an important part of an ink jet head H according to Embodiment 2 of the present invention. In the figures illustrating this and subsequent embodiments, those elements already shown in FIG. 2 are provided with the same reference numerals and will not be further described below. Moreover, in this and subsequent embodiments, the structure of the ink jet type recording apparatus will not be further described since it is as described above in Embodiment 1.

In the present embodiment, the positional relationship between the common electrode 4 and the separate electrode 5 is reversed from that in Embodiment 1. Thus, the common electrode 4 is provided on one surface (the upper surface in the illustrated example) of the piezoelectric layer 3 which is away from the pressure chamber structure member 1, and the separate electrode 5 is provided on the other surface (the lower surface in the illustrated example) of the piezoelectric layer 3 which is closer to the pressure chamber structure member 1.

Accordingly, the restriction plate 6 for each displacement section 2*a* is provided on the common electrode 4, and the auxiliary separate electrode 5*a* for each expansion/contraction section 2*b* is provided on one surface (the lower surface in the illustrated example) of the piezoelectric layer 3 which is closer to the pressure chamber structure member 1. In addition, an electrically insulative layer 7 is provided entirely across the surface of the pressure chamber structure member 1. The separate electrode 5 and the auxiliary separate electrodes 5*a* are provided in the upper surface of the electrically insulative layer 7. The piezoelectric layer 3 is provided on the electrically insulative layer 7, the separate electrode 5 and the auxiliary separate electrodes 5*a*. The electrically insulative layer 7 serves to prevent the potential of the separate electrode 5 and the auxiliary separate electrodes 5*a* from being changed via ink in the pressure chamber 1*a*, while also serving to prevent the piezoelectric layer 3 from deteriorating due to a contact with the ink.

In the present embodiment, the method for applying respective voltages between the common electrode 4 and the separate electrode 5 and between the common electrode 4 and the auxiliary separate electrodes 5*a* is the same as that of Embodiment 1. Thus, advantageous effects as those of Embodiment 1 can be obtained.

Embodiment 3

Figure 4:
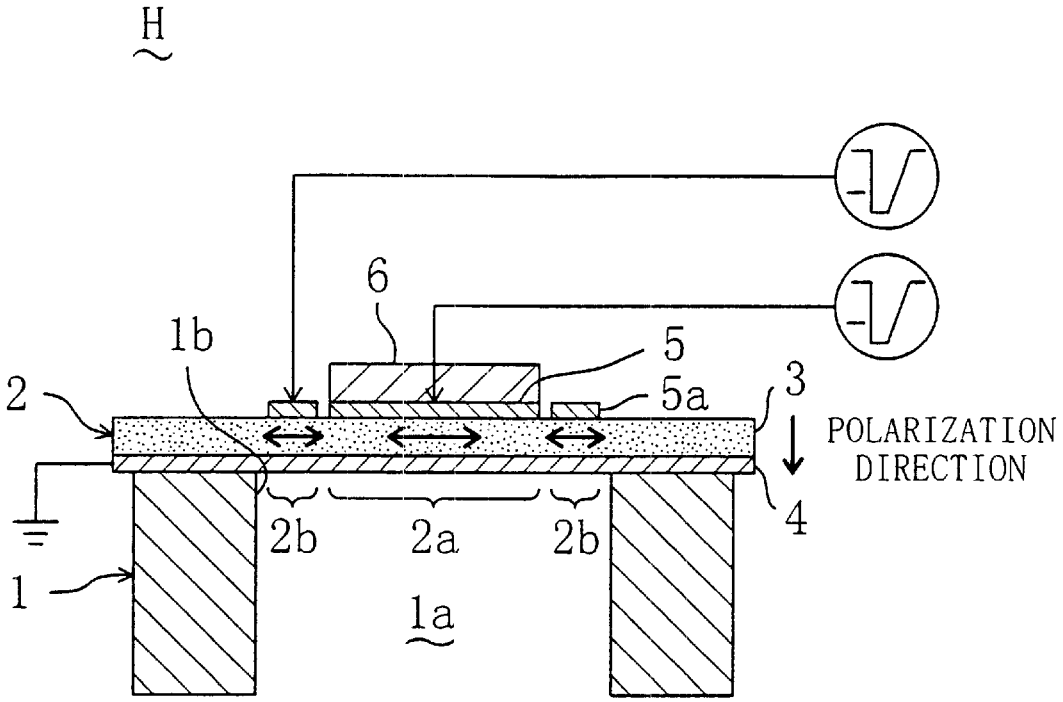
FIG. 4 is a cross-sectional view schematically illustrating an important part of an ink jet head according to Embodiment 3 of the present invention.

FIG. 4 schematically illustrates an important part of an ink jet head H according to Embodiment 3 of the present invention.

In the present embodiment, the structure of the ink jet head H is the same as that of Embodiment 1. A difference between the present embodiment and Embodiments 1 and 2 is that when the separate electrode 5 in one displacement section 2*a* has a negative potential, each auxiliary separate electrode 5*a* in the corresponding expansion/contraction section 2*b* also has a negative potential, as opposed to Embodiments 1 and 2. Specifically, an electric field of the opposite direction to the polarization direction of the piezoelectric layer 3 is produced between the common electrode 4 and the separate electrode 5 in the displacement section 2*a* as between the common electrode 4 and the auxiliary separate electrodes 5*a* in the corresponding expansion/contraction section 2*b*.

The operation of the ink jet head H having such a structure will be described below. In each displacement section 2*a* of the piezoelectric actuator 2, an electric field of the opposite direction to the polarization direction of the piezoelectric layer 3 is produced between the common electrode 4 and the separate electrode 5, whereby the piezoelectric layer 3 in the displacement section 2*a* expands in the planar direction. As a result, the displacement section 2*a* is displaced into a concave shape protruding toward the pressure chamber structure member 1, as opposed to Embodiments 1 and 2.

In each of the expansion/contraction sections 2*b* corresponding to the displacement section 2*a*, an electric field of the opposite direction to the polarization direction of the piezoelectric layer 3, as that in the displacement section 2*a*, is produced between the common electrode 4 and the auxiliary separate electrode 5*a*. As a result, the piezoelectric layer 3 in the expansion/contraction section 2*b* expands in the planar direction, thereby expanding the expansion/contraction section 2*b* in the planar direction.

Thus, the expansion of the corresponding pair of expansion/contraction sections 2*b* in the planar direction is added to the expansion of the piezoelectric layer 3 in the displacement section 2*a* itself, whereby the amount of displacement of the displacement section 2*a* in the thickness direction is increased as compared to when only the piezoelectric layer 3 in the displacement section 2*a* itself expands.

The displacement section 2*a* returns to the original flat shape at the rising edge of the pulse voltage applied between the common electrode 4 and the separate electrode 5. At the same time, the pulse voltage applied between the common electrode 4 and the auxiliary separate electrodes 5*a* also rises, thereby contracting the expansion/contraction sections 2*b*. As a result, the displacement of the displacement section 2*a* into the flat shape is facilitated.

As a result of the displacement of the displacement section 2*a* in the thickness direction, the volume of the corresponding pressure chamber 1*a* is once reduced and then increased to the original volume, as opposed to Embodiments 1 and 2. The reduction in the volume of the pressure chamber 1*a* discharges ink from the pressure chamber 1*a* onto the recording paper 51 through the nozzle, and the increase in the volume of the pressure chamber 1*a* fills the pressure chamber 1*a* with ink.

Thus, in the present embodiment, as in Embodiment 1, it is possible to improve the deformation characteristic of the piezoelectric actuator 2, and to improve the ink discharging capability and thus the printed image quality.

Embodiment 4

Figure 5:
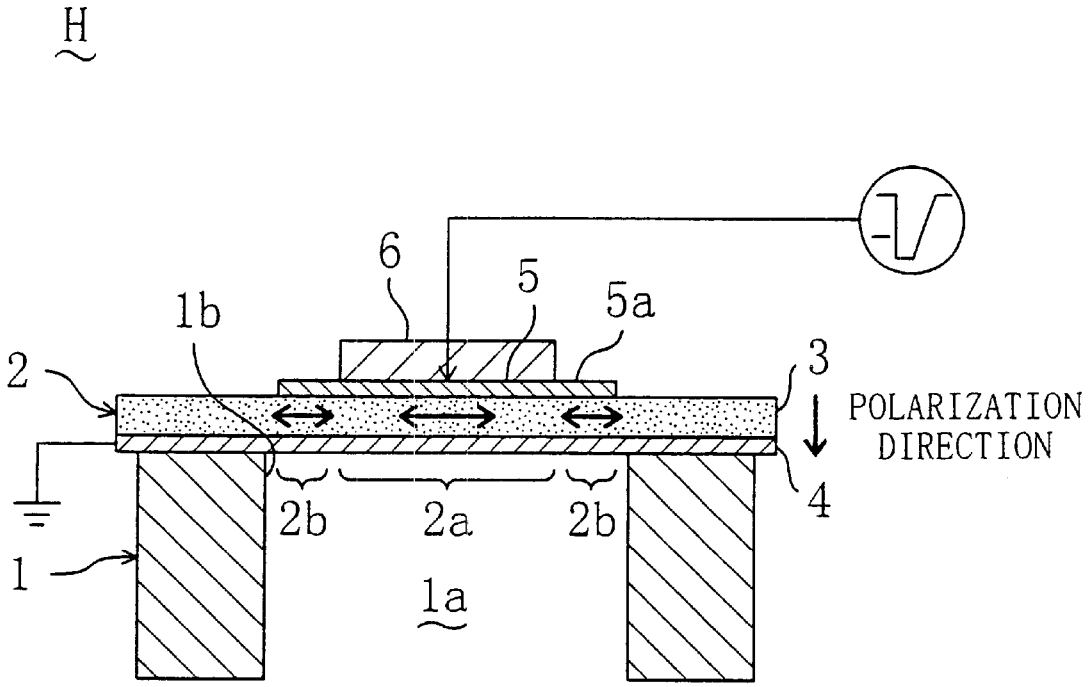
FIG. 5 is a cross-sectional view schematically illustrating an important part of an ink jet head according to Embodiment 4 of the present invention.

FIG. 5 schematically illustrates an important part of an ink jet head H according to Embodiment 4 of the present invention.

The present embodiment is similar to Embodiment 3 above except that the auxiliary separate electrodes 5*a* of each pair of expansion/contraction sections 2*b* are provided to be integral with the separate electrode 5 in the corresponding displacement section 2*a*. Accordingly, the same voltage is applied between the common electrode 4 and the separate electrode 5 in the displacement section 2*a* and between the common electrode 4 and the auxiliary separate electrodes 5*a* in the corresponding expansion/contraction sections 2*b* by using the same voltage application means.

In the present embodiment, while advantageous effects as those of Embodiment 3 above can be obtained, it is also possible to eliminate means for applying a voltage between the common electrode 4 and the auxiliary separate electrode 5*a* in each expansion/contraction section 2*b*. Thus, it is possible to prevent the driving circuit for the piezoelectric layer 3 from becoming complicated due to the additional provision of the auxiliary separate electrodes 5*a* in the piezoelectric actuator 2.

Embodiment 5

Figure 6:
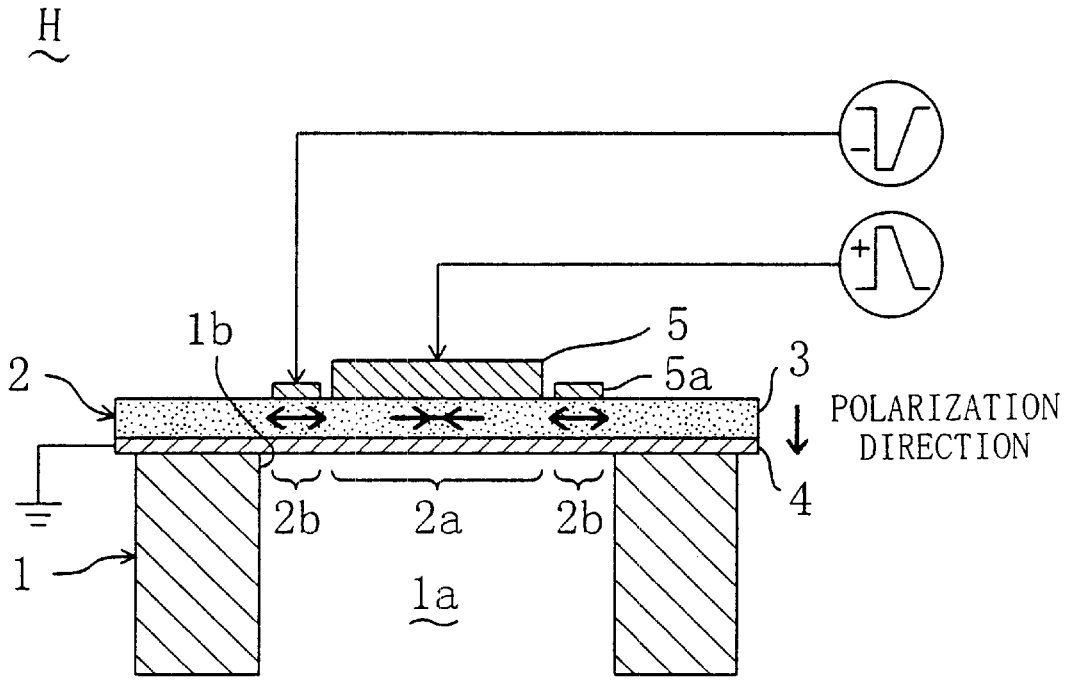
FIG. 6 is a cross-sectional view schematically illustrating an important part of an ink jet head according to Embodiment 5 of the present invention.

FIG. 6 schematically illustrates an important part of an ink jet head H according to Embodiment 5 of the present invention.

The present embodiment is similar to Embodiment 1 above except that the degree of restriction of the separate electrode 5 against the expansion/contraction in the planar direction of the piezoelectric layer 3 in each displacement section 2*a* of the piezoelectric actuator 2 is increased so that the separate electrode 5 can be used to restrict the expansion/contraction of the piezoelectric layer 3 in the planar direction. In other words, the restriction plate 6 used in Embodiment 1 above is eliminated by designing the separate electrode 5 so that the separate electrode 5 also functions as a restriction plate.

Therefore, in the present embodiment, while advantageous effects as those of Embodiment 1 above can be obtained, it is also possible to eliminate the restriction plate. Thus, it is possible to prevent the structure of the ink jet head H from becoming complicated due to the additional provision of the auxiliary separate electrodes 5*a* in the piezoelectric actuator 2.

In Embodiments 1 to 5 described above, a pair of auxiliary separate electrodes 5*a* are provided for each separate electrode 5 respectively on opposite sides of the separate electrode 5 along the longitudinal direction thereof. The arrangement of the auxiliary separate electrodes 5*a* may be changed suitably in view of various conditions such as, for example, the shape of the opening 1*b* of the pressure chamber 1*a* and the shape of the separate electrode 5 therefor. It is not necessary for the auxiliary separate electrode 5*a* to be in an area within which the piezoelectric layer 3 can expand/contract in the planar direction, and the auxiliary separate electrode 5*a* may alternatively extend out of the corresponding opening 1*b* beyond the boundary thereof.

In Embodiments 1 to 5 described above, the piezoelectric layer 3 is polarized downwardly. Alternatively, the piezoelectric layer 3 may be polarized upwardly. In such a case, the common electrode 4 and the separate electrodes 5 and the auxiliary separate electrodes 5*a* can be positionally switched with respect to each other, or the polarity of the potential can be reversed from that described above for each of voltages applied respectively between the common electrode 4 and the separate electrode 5 and between the common electrode 4 and the auxiliary separate electrode 5*a*.

In Embodiments 1 to 5 described above, the portions of the piezoelectric actuator 2 corresponding to the respective openings 1*b* of the pressure chambers 1*a* are provided in a flat shape. Alternatively, these portions can be provided in a convex shape protruding away from the pressure chamber structure member 1 or in a concave shape protruding toward the pressure chamber structure member 1.

In Embodiments 1 to 5 described above, whether the piezoelectric layer 3 in the displacement section 2*a* of the piezoelectric actuator 2 contracts or expands in the planar direction, the corresponding pair of expansion/contraction sections 2*b* are expanded in the planar direction. Alternatively, the expansion/contraction sections 2*b* can be contracted in the planar direction depending on various conditions such as how the displacement of the displacement section 2*a* is controlled. For example, the expansion/contraction sections 2*b* can be contracted in the planar direction in a case where each displacement section 2*a* of the piezoelectric actuator 2 is provided in a convex shape protruding away from the pressure chamber structure member 1 so that ink is discharged from the pressure chamber 1*a* by displacing the displacement section 2*a* toward the pressure chamber structure member 1.

In Embodiments 1 to 5 described above, the common electrode 4 is provided substantially entirely across one surface of the pressure chamber structure member 1 along which the openings 1*b* of the pressure chambers 1*a* are provided. Alternatively, the common electrode 4 may be divided into pieces so as to be provided only in portions of the piezoelectric actuator 2 which respectively correspond to the openings 1*b* of the pressure chambers 1*a*. However, providing the common electrode 4 substantially entirely across the surface of the pressure chamber structure member 1 is simpler because it is then not necessary to divide the common electrode 4 into portions and to provide wirings, or the like, for connecting the common electrode portions together.

In Embodiments 1 to 5 described above, the restriction plate 6 is provided on the side of the piezoelectric actuator 2 which is away from the pressure chamber structure member 1. Alternatively, the restriction plate 6 may be provided on the other side of the piezoelectric actuator 2 which is closer to the pressure chamber structure member 1.

Embodiment 6

Figure 7:
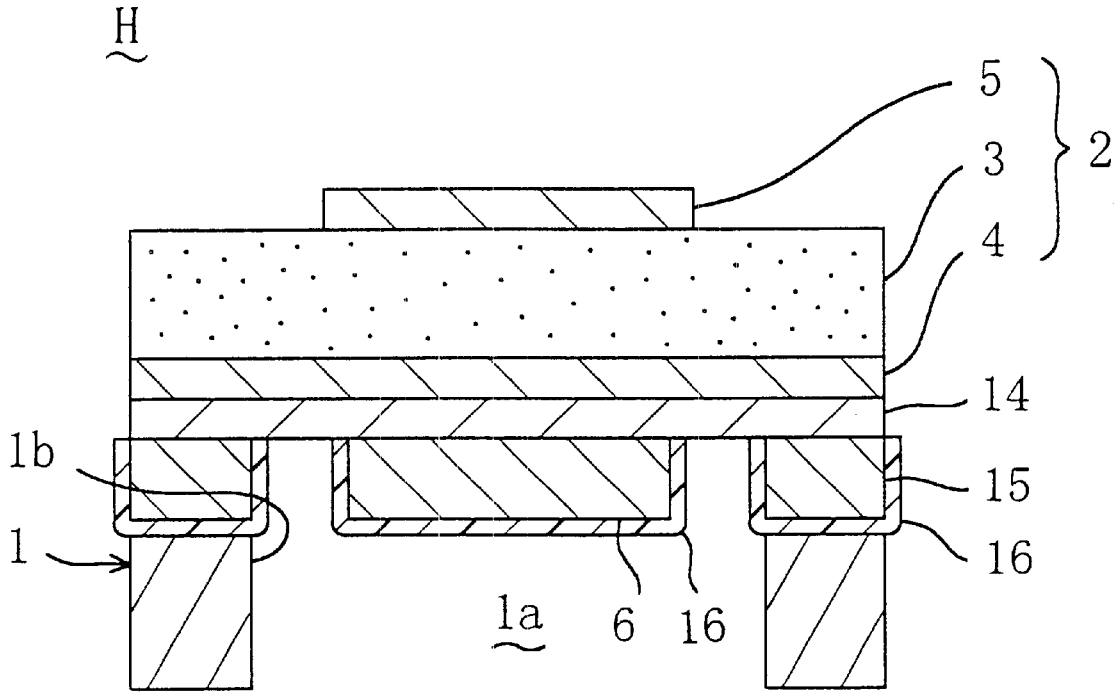
FIG. 7 is a cross-sectional view schematically illustrating an important part of an ink jet head according to Embodiment 6 of the present invention.

FIG. 7 schematically illustrates an important part of an ink jet head H according to Embodiment 6 of the present invention.

The present embodiment is different from Embodiments 1 to 5 described above in that the auxiliary separate electrodes 5*a* are not provided, and the restriction plate 6 is provided for each of the openings 1*b* of the pressure chambers 1*a* on the same side of the piezoelectric actuator 2 as the pressure chamber structure member 1 in a position corresponding to the opening 1*b*. The restriction plate 6 has a smaller size than the size of the opening 1*b* of the pressure chamber 1*a*, and only extends generally over the center of the opening 1*b*. As the restriction plate 6, the separate electrode 5 also has a smaller size than the size of the opening 1*b* of the pressure chamber 1*a*, and only extends generally over the center of the opening 1*b*.

In the present embodiment, the separate electrode 5 is provided on one side of the piezoelectric layer 3 which is away from the pressure chamber structure member 1, and the common electrode 4 is provided on the other side of the piezoelectric layer 3 which is closer to the pressure chamber structure member An electrically insulative layer 14 is provided on one side of the piezoelectric actuator 2 which is closer to the pressure chamber structure member 1, i.e., on the lower surface of the common electrode 4, so as to substantially cover the entire surface. The restriction plate 6 is secured to the piezoelectric actuator 2 via the electrically insulative layer 14. Thus, the displacement section of the piezoelectric actuator 2 which is displaced in the thickness direction of the piezoelectric layer 3 includes the separate electrode 5, the piezoelectric layer 3, the common electrode 4, the electrically insulative layer 14 and the restriction plate 6, whereas a support section (a portion surrounding the displacement section) for displaceably supporting the displacement section includes the piezoelectric layer 3, the common electrode 4 and the electrically insulative layer 14.

An intermediate structure member 15 is provided on the lower surface of the electrically insulative layer 14 the intermediate structure member 15 is shaped so as to avoid the openings 1*b* of the pressure chambers 1*a*. The pressure chamber structure member 1 and the piezoelectric actuator 2 are bonded together via the intermediate structure member 15 by means of an electro-deposition resin 16. The intermediate structure member 15 and the restriction plate 6 are made of the same electrically conductive material.

The operation of the ink jet head H having such a structure will now be described.

In the ink jet head H, upon application of a predetermined voltage between the common electrode 4 and each separate electrode 5, the portion of the piezoelectric layer 3 corresponding to the separate electrode 5 expands/contracts in the planar direction. The expansion/contraction of the portion of the piezoelectric layer 3 on the side of the pressure chamber structure member 1 is restricted by the restriction plate 6, whereby the expansion/contraction of the portion of the piezoelectric layer 3 in the planar direction is converted into a displacement in the thickness direction. The displacement of the portion of the piezoelectric layer 3 in the thickness direction entailing the separate electrode 5, etc., changes the volume of the corresponding pressure chamber 1*a*, thereby discharging ink from the pressure chamber 1*a* onto the recording paper 51 through the nozzle.

Since the piezoelectric layer 3 is provided substantially entirely across one surface (the upper surface in the illustrated example) of the pressure chamber structure member 1 along which the openings 1*b* of the pressure chambers 1*a* are provided, the electrical insulation between the common electrode 4 and the separate electrode 5 along the thickness direction of the piezoelectric layer 3 is reliably ensured by the piezoelectric layer 3. As a result, an electrical discharge between the common electrode 4 and the separate electrode 5 is less likely to occur as compared to a case where the piezoelectric layer 3 is provided only in a portion of the piezoelectric actuator 2 corresponding to the opening 1*b* of each of the pressure chambers la.

The support section for displaceably supporting the displacement section is formed by the common electrode 4 with the piezoelectric layer 3 and the electrically insulative layer 14 being attached to the common electrode 4. Therefore, the thickness of the support section is increased by the thicknesses of the piezoelectric layer 3 and the electrically insulative layer 14. However, since the restriction plate 6 is provided in a portion of the piezoelectric actuator 2 corresponding to the opening 1*b* of each of the pressure chambers 1*a*, the common electrode 4 does not need to function as a restriction plate. Accordingly, the common electrode 4 can be made more flexible. Moreover, an additional flexibility is added to the support section because the restriction plate 6 is not provided in the support section. This, along with the reduced likeliness of an electrical discharge between the common electrode 4 and the separate electrode 5, improves the deformation characteristic of the piezoelectric actuator 2.

The restriction plate 6 is provided on the surface of the piezoelectric actuator 2 which is closer to the pressure chamber structure member 1. Thus, as compared to a case where the restriction plate 6 is provided on the other surface of the piezoelectric actuator 2 which is away from the pressure chamber structure member 1, the height of the protruding structure resulting on the other surface of the piezoelectric actuator 2 can be reduced considerably. As a result, even when the ink jet head H is produced by a method which involves a certain degree of pressure acting upon the protruding structure, it is unlikely that an abnormal force acts upon the piezoelectric layer 3 to cause a crack, or the like. Thus, it is possible to prevent the deformation characteristic of the piezoelectric actuator 2 from deteriorating due to a crack in the piezoelectric layer 3, or the like, while increasing the freedom in the selection of production methods.

The surface of the piezoelectric actuator 2 which is closer to the pressure chamber structure member 1 is covered with the electrically insulative layer 14. Therefore, in a case where a positive potential, for example, is applied to the common electrode 4 to drive the piezoelectric actuator 2, it is possible to avoid situations where the common electrode 4 is electrically connected to the ground side via the ink contained in the pressure chamber 1*a,* thereby reducing the potential of the common electrode 4.

Next, a method for producing the ink jet head H as described above will be described with reference to FIGS. 8A to 8J.

Figure 8A:
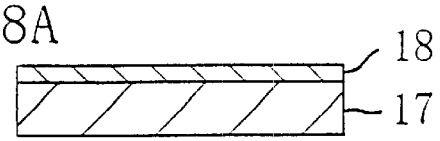
FIGS. 8A to 8J illustrate a series of steps for producing the ink jet head of FIG. 7.

First, referring to FIG. 8A, a substrate 17 is provided, and a separate electrode layer 18, from which the separate electrodes 5 are provided, is formed on the substrate 17.

Figure 8B:
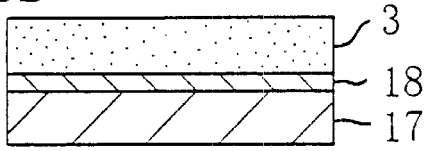
Figure 8C:
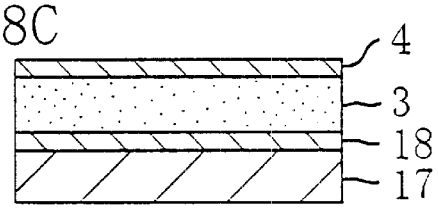
Figure 8D:
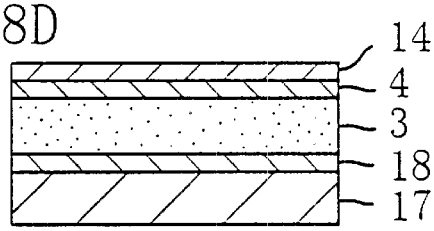

Then, referring to FIGS. 8B to 8D, the piezoelectric layer 3, the common electrode 4 and the electrically insulative layer 14 are formed in this order on the separate electrode layer 18. The separate electrode layer 18, the piezoelectric layer 3, the common electrode 4 and the electrically insulative layer 14 are provided substantially entirely across the substrate 17.

Figure 8E:
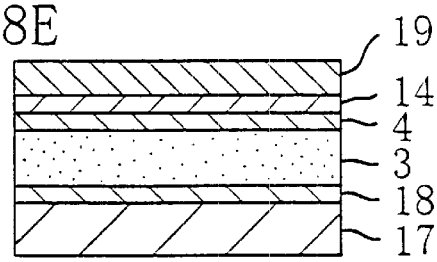

Then, referring to FIG. 8E, a restriction plate layer 19 is formed on the electrically insulative layer 14. The restriction plate layer 19 is also provided substantially entirely across the substrate 17.

Figure 8F:
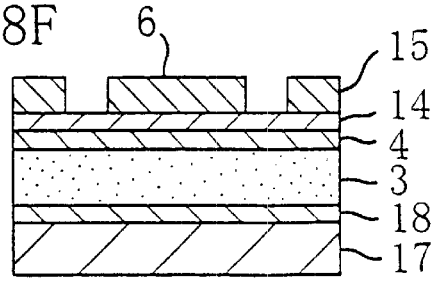

Then, referring to FIG. 8F, the restriction plate layer 19 is patterned into a predetermined pattern, thereby providing the plurality of restriction plates 6 and the intermediate structure member 15.

Figure 8G:
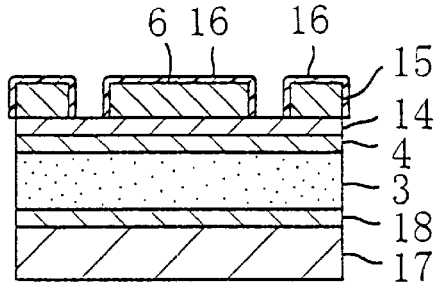

Then, referring to FIG. 8G, the restriction plate 6 and the intermediate structure member 15 are covered with the electro-deposition resin 16 which has a function as an adhesive. Since the restriction plate 6 and the intermediate structure member 15 are made of an electrically conductive material, the restriction plate 6 and the intermediate structure member 15 are used as electro-deposition electrodes.

Thus, an intermediate product is obtained, in which the separate electrode layer 18, the piezoelectric layer 3, the common electrode 4, the electrically insulative layer 14, and the restriction plate 6 and the intermediate structure member 15 covered with the electro-deposition resin 16, are layered on the substrate 17.

Figure 8H:
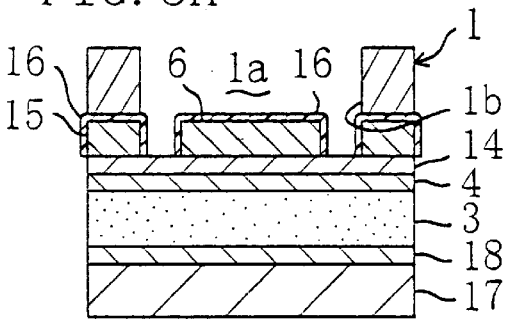

Then, referring to FIG. 8H, the pressure chamber structure member 1 having the pressure chambers 1*a* and the openings 1*b* already provided therein is bonded to the intermediate product so that the restriction plates 6 and the intermediate structure member 15 are on the side of the pressure chamber structure member 1 while the restriction plates 6 correspond to the respective pressure chambers 1*a* (the respective openings 1*b*). The bonding is effected by means of the electro-deposition resin 16 on the intermediate structure member 15.

Figure 8I:
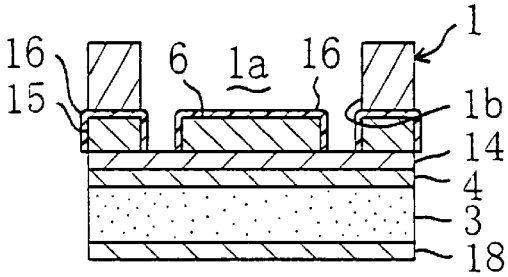

Then, referring to FIG. 8I, the substrate 17 is removed from the intermediate product on the pressure chamber structure member 1.

Figure 8J:
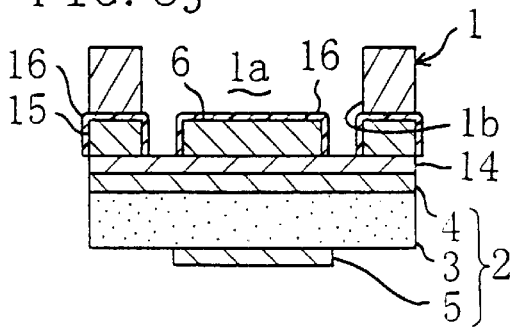

Then, referring to FIG. 8J, the separate electrode layer 18 is patterned into a predetermined pattern, thereby providing the plurality of separate electrodes 5. Thus, the ink jet head H is obtained.

Where, after the separate electrodes 5 are formed, a nozzle plate having nozzles formed therein, or the like, is attached to the side of the pressure chamber structure member 1 which is away from the piezoelectric actuator 2, a pressure acts upon the separate electrodes 5 (the protruding structures). However, the height of the protruding structures is considerably reduced as described above, whereby it is unlikely that an abnormal force acts upon the piezoelectric layer 3 to cause a crack, or the like, during the attachment process.

In the present embodiment, the piezoelectric layer 3 is provided substantially entirely across one surface (the upper surface in the illustrated example as shown in FIG. 7) of the pressure chamber structure member 1 along which the openings 1*b* of the pressure chambers 1*a* are provided, whereas the restriction plate 6 is provided on the surface of the piezoelectric actuator 2 which is closer to the pressure chamber structure member 1 in a position corresponding to the opening 1*b* of each of the pressure chambers 1*a*. Therefore, as in Embodiments 1 to 5 described above, it is possible to improving the deformation characteristic of the piezoelectric actuator 2 as much as possible, and to improve the ink discharging capability and thus the printed image quality.

The electrically insulative layer 14 is provided substantially entirely across the surface of the piezoelectric actuator 2 which is closer to the pressure chamber structure member 1, so that the restriction plates 6are secured to the piezoelectric actuator 2 via the electrically insulative layer 14. Therefore, it is possible to avoid situations where the potential of the common electrode 4 is electrically connected to the ground side via the ink contained in the pressure chamber 1*a*.

The production process of the ink jet head H is designed so that when providing the intermediate structure member 15 to be integral with the piezoelectric actuator 2, the intermediate structure member 15 is provided from the same material as the restriction plates 6. Therefore, when providing the restriction plates 6 from the restriction plate layer 19, the intermediate structure member 15 can be provided from the restriction plate layer 19 simultaneously with the restriction plates 6. Thus, it is possible to suppress the possible increase in the number of production steps due to the provision of the intermediate structure member 15.

In order to bond the pressure chamber structure member 1 and the piezoelectric actuator 2 to each other by means of the electro-deposition resin 16, the intermediate structure member 15 is made of an electrically conductive material so that the intermediate structure member 15 can be used as an electro-deposition electrode for electro-deposition of the electro-deposition resin 16 onto the intermediate structure member 15. Thus, the possible need for providing a separate electro-deposition electrode is eliminated, thereby reducing the number of production steps.

In Embodiment 6 above, the separate electrodes 5 are provided on the surface of the piezoelectric layer 3 which is away from the pressure chamber structure member 1, while providing the common electrode 4 on the other surface of the piezoelectric layer 3 which is closer to the pressure chamber structure member 1. Alternatively, the separate electrodes 5 may be provided on the surface of the piezoelectric layer 3 which is closer to the pressure chamber structure member 1, while providing the common electrode 4 on the other surface of the piezoelectric layer 3 which is away from the pressure chamber structure member 1.

In Embodiment 6 above, the electrically insulative layer 14 is provided on the side of the piezoelectric actuator 2 which is closer to the pressure chamber structure member 1. However, the electrically insulative layer 14 may be optional if, for example, the electrode on the side of the piezoelectric layer 3 which is closer to the pressure chamber structure member 1 is the common electrode 4, as in Embodiment 6, and the ground side potential is applied to the common electrode 4.

In Embodiment 6 above, an electrically conductive material is used for the restriction plate layer 19. Alternatively, other known types of materials may be used as the material for restriction plates.

In Embodiment 6 above, the intermediate structure member 15 is provided from the restriction plate layer 19 simultaneously with the restriction plates 6. Alternatively, the intermediate structure member 15 may be provided in a separate step from the restriction plates 6 and/or by using a different material from the restriction plates 6.

In Embodiment 6 above, the pressure chamber structure member 1 and the piezoelectric actuator 2 are bonded together via the intermediate structure member 15. Alternatively, the pressure chamber structure member 1 and the piezoelectric actuator 2 may be bonded together directly without using the intermediate structure member 15 therebetween.

Embodiment 7

Figure 9:
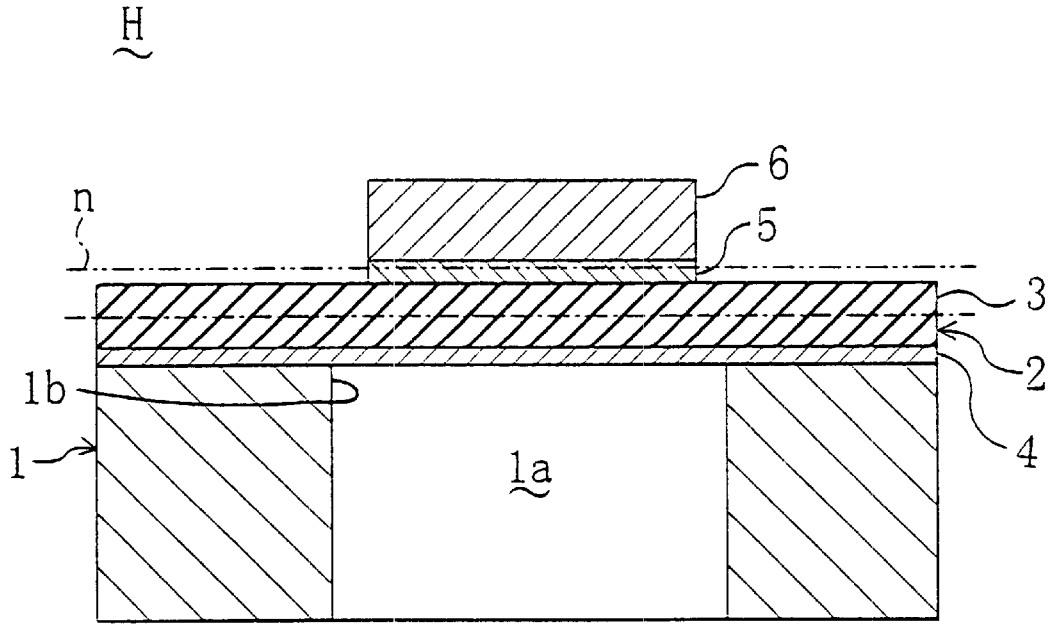
FIG. 9 is a cross-sectional view schematically illustrating an important part of an ink jet head according to Embodiment 7 of the present invention.

FIG. 9 schematically illustrates an important part of an ink jet head H according to Embodiment 7 of the present invention. The present embodiment is substantially the same as Embodiment 1 above with the auxiliary separate electrodes 5*a* being removed therefrom and except that the piezoelectric layer 3 of the piezoelectric actuator 2 is a thin film obtained by a sputtering method.

In the piezoelectric actuator 2 of the ink jet head H, upon application of a predetermined voltage between the common electrode 4 and each separate electrode 5, an electric field is produced between the electrodes 4 and 5. As a result, the corresponding portion of the piezoelectric layer 3 expands/contracts in the planar direction according to the direction and the intensity of the electric field. Since the expansion/contraction of such a portion of the piezoelectric layer 3 in the planar direction is restricted by the restriction plate 6 on the side which is closer to the separate electrode 5, the expansion/contraction of the portion in the planar direction is converted into a displacement in the thickness direction.

As a result of the conversion of the expansion/contraction of the piezoelectric layer 3 in the planar direction into a displacement in the thickness direction, a portion of the piezoelectric actuator 2 corresponding to the opening 1*b* of each of the pressure chambers 1*a* is displaced in the thickness direction while being supported by the surrounding portion. Since the restriction plate 6 is not present in the surrounding portion (the support section) and the piezoelectric layer 3 is a thin film obtained by a sputtering method, the high flexibility of the piezoelectric actuator 2 is retained even though the piezoelectric layer 3 is provided substantially entirely across the surface of the piezoelectric actuator 2. Regarding the displacement of the portion of the piezoelectric actuator 2 in the thickness direction, since the restriction plate 6 is provided on the side of the piezoelectric layer 3 which is away from the pressure chamber structure member 1, a neutral plane n (indicated by a two-dot chain line in FIG. 9) for the displacement of the portion of the piezoelectric actuator 2 is located away from the pressure chamber structure member 1 with respect to the center of the piezoelectric layer 3 along the thickness direction (indicated by a one-dot chain line in FIG. 9).

Next, a method for producing the ink jet head H will be described.

First, in order to provide the pressure chamber structure member 1, a substrate made of magnesium oxide, silicon, or the like, is provided, and the common electrode 4 and the piezoelectric layer 3 are provided in this order on the substrate by using a sputtering method substantially entirely across the surface of the substrate.

Then, a separate electrode layer and a restriction plate layer are provided in this order on the piezoelectric layer 3 by using a sputtering method substantially entirely across the surface of the piezoelectric layer 3.

Then, the separate electrode layer and the restriction plate layer are patterned by etching into a predetermined pattern so as to provide the separate electrodes 5 and the restriction plates 6 from the separate electrode layer and the restriction plate layer, respectively.

Then, the substrate is etched to provide the pressure chambers 1*a* and the openings 1*b* therein so as to correspond to the separate electrodes 5, respectively, thereby obtaining the pressure chamber structure member 1 from the substrate. Thus, the ink jet head H is obtained through these steps as described above.

In the production method described above, it is possible to produce the piezoelectric layer 3 with a very good piezoelectric characteristic when a substrate made of magnesium oxide is used as the substrate. When a substrate made of silicon is used, the formation of the pressure chambers 1*a*, etc., is facilitated.

In the present embodiment, the piezoelectric layer 3 is provided substantially entirely across one surface (the upper surface in the illustrated example) of the pressure chamber structure member 1 along which the openings 1*b* of the pressure chambers 1*a* are provided. Therefore, as in Embodiment 6 above, it is possible to suppress the possible electrical discharge between the common electrode 4 and the separate electrode 5 and to prevent the deformation characteristic of the piezoelectric actuator 2 from deteriorating. Moreover, since the piezoelectric layer 3 is provided as a thin film by using a sputtering method, it is possible to stabilize the thickness and also to improve the stress resisting property thereof. As a result, it is possible to easily and stably produce the piezoelectric actuator 2 which has a high flexibility and a high mechanical strength. Thus, as in Embodiment 6 above, it is possible to improve the deformation characteristic of the piezoelectric actuator 2 as much as possible, and to improve the ink discharging capability and thus the printed image quality.

Embodiment 8

Figure 10:
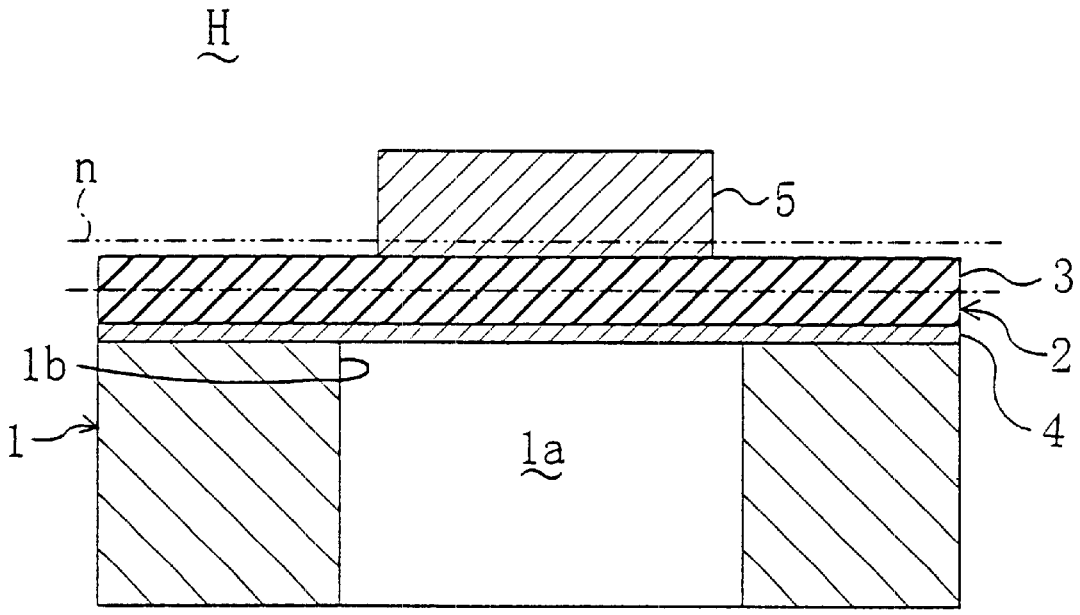
FIG. 10 is a cross-sectional view schematically illustrating an important part of an ink jet head according to Embodiment 8 of the present invention.
Figure 11:
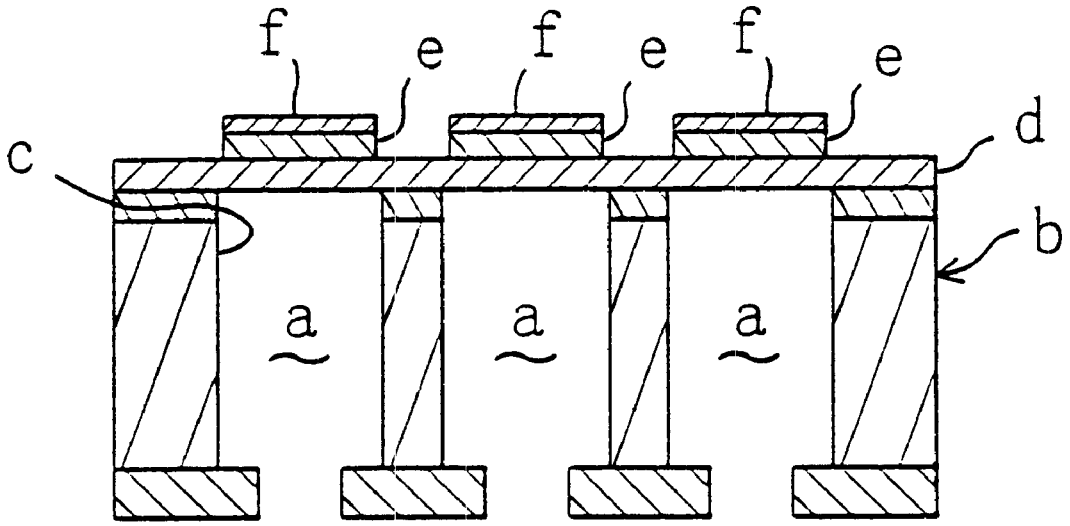
FIG. 11 is a cross-sectional view schematically illustrating a conventional ink jet head.

FIG. 10 schematically illustrates an important part of an ink jet head H according to Embodiment 8 of the present invention.

The present embodiment is similar to Embodiment 7 above except that the restriction plates 6 are omitted. Instead of providing the restriction plates 6, the separate electrodes 5 are provided with, for example, a greater thickness than that in Embodiment 7 above so that the degree of restriction thereof against the expansion/contraction of the piezoelectric layer 3 in the planar direction is greater than that of the common electrode 4. Other than this, the structure and the production method of the present embodiment are similar to those of Embodiment 7 above.

Therefore, in the present embodiment, advantageous effects as those of Embodiment 7 above can be obtained. In addition, since the present embodiment does not use the restriction plates 6 as in Embodiment 7 above, it is also possible to eliminate the step of providing the restriction plate layer and the step of patterning the restriction plate layer, thereby simplifying the structure and the production process of the ink jet head H.

What is claimed is:

1. An ink jet head, comprising:

a pressure chamber structure member comprising a plurality of pressure chambers which are filled with ink, and a plurality of openings respectively for the pressure chambers which are provided along a predetermined surface of the pressure chamber structure member; and a piezoelectric actuator provided on one surface of the pressure chamber structure member along which the openings of the pressure chambers are provided, wherein:

the piezoelectric actuator comprises a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction;

each portion of the piezoelectric actuator which corresponds to the opening of one of the pressure chambers and which generally corresponds to a center of the opening is defined as a displacement section, wherein when an electric field for expanding/contracting the piezoelectric layer in the planar direction is applied across a portion of the piezoelectric layer corresponding to the displacement section, the expansion/contraction of the piezoelectric layer in the planar direction is converted to a displacement in the thickness direction, whereby the displacement section is displaced in the thickness direction as a result of the conversion;

each portion of the piezoelectric actuator which corresponds to the opening of one of the pressure chambers and which is in a vicinity of the displacement section is defined as an expansion/contraction section, wherein when an electric field for expanding/contracting the piezoelectric layer in the planar direction is applied across a portion of the piezoelectric layer corresponding to the expansion/contraction section, the expansion/contraction section expands/contracts in the planar direction by the expansion/contraction of the piezoelectric layer in the planar direction; and the displacement of the displacement section in the thickness direction is controlled by the expansion/contraction of the expansion/contraction section in the planar direction, so that the displacement of the displacement section in the thickness direction changes a volume of the corresponding pressure chamber, thereby discharging ink from the pressure chamber to the outside.

2. The ink jet head of claim 1, wherein in addition to the piezoelectric layer, the piezoelectric actuator further comprises: a common electrode provided at least in each portion of the piezoelectric actuator which corresponds to the opening of one of the pressure chambers on one of surfaces of the piezoelectric layer which are perpendicular to the thickness direction thereof; a separate electrode provided in each displacement section on the other one of the surfaces of the piezoelectric layer which are perpendicular to the thickness direction thereof for producing an electric field of a predetermined direction between the separate electrode and the common electrode; and an auxiliary separate electrode provided in each expansion/contraction section on the same surface of the piezoelectric layer as the separate electrode for producing an electric field of a predetermined direction between the auxiliary separate electrode and the common electrode.

3. The ink jet head of claim 2, wherein the common electrode is provided substantially entirely across one surface of the pressure chamber structure member along which the openings of the pressure chambers are provided.

4. The ink jet head of claim 2, wherein the common electrode is provided only in each portion of the piezoelectric actuator which corresponds to the opening of one of the pressure chambers.

5. The ink jet head of claim 2, wherein the auxiliary separate electrode is provided only in an area within which the piezoelectric layer can expand/contract in the planar direction.

6. The ink jet head of claim 2, wherein when a voltage is applied between the common electrode and the separate electrode in one displacement section, the voltage producing an electric field of such a direction as to contract the piezoelectric layer in the displacement section, a voltage is applied between the common electrode and the auxiliary separate electrode in each expansion/contraction section corresponding to the displacement section, the voltage producing an electric field of such a direction as to expand the piezoelectric layer in the expansion/contraction section.

7. The ink jet head of claim 2, wherein when a voltage is applied between the common electrode and the separate electrode in one displacement section, the voltage producing an electric field of such a direction as to expand the piezoelectric layer in the displacement section, a voltage is applied between the common electrode and the auxiliary separate electrode in each expansion/contraction section corresponding to the displacement section, the voltage producing an electric field of such a direction as to expand the piezoelectric layer in the expansion/contraction section.

8. The ink jet head of claim 7, wherein the auxiliary separate electrode in each expansion/contraction section is provided to be integral with the separate electrode in the corresponding displacement section.

9. An ink jet head, comprising:

a pressure chamber structure member comprising a plurality of pressure chambers which are filled with ink, and a plurality of openings respectively for the pressure chambers which are provided along a predetermined surface of the pressure chamber structure member; and a piezoelectric actuator provided on one surface of the pressure chamber structure member along which the openings of the pressure chambers are provided, wherein:

the piezoelectric actuator comprises: a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction; a common electrode provided on one of surfaces of the piezoelectric layer which are perpendicular to the thickness direction thereof; and a separate electrode provided on the other one of the surfaces of the piezoelectric layer which are perpendicular to the thickness direction thereof for producing the electric field of a predetermined direction between the separate electrode and the common electrode;

a restriction plate for restricting expansion/contraction in the planar direction of a portion of the piezoelectric layer on one side thereof which is closer to the pressure chamber structure member is provided in each portion of the piezoelectric actuator which corresponds to the opening of one of the pressure chambers on one surface of the piezoelectric actuator which is closer to the pressure chamber structure member; and the expansion/contraction of the piezoelectric layer in the planar direction is converted by the restriction plate into a displacement in the thickness direction thereof to displace in the thickness direction a portion of the piezoelectric actuator which corresponds to the opening of the pressure chamber so as to change a volume of the corresponding pressure chamber, thereby discharging ink from the pressure chamber to the outside.

10. The ink jet head of claim 9, wherein the separate electrode is provided on the surface of the piezoelectric layer which is away from the pressure chamber structure member.

11. The ink jet head of claim 9, wherein:

an electrically insulative layer is provided substantially entirely across the surface of the piezoelectric actuator which is closer to the pressure chamber structure member; and each restriction plate is secured to the piezoelectric actuator via the electrically insulative layer.

12. The ink jet head of claim 9, wherein:

the pressure chamber structure member and the piezoelectric actuator are bonded together via an intermediate structure member which is provided to be integral with the piezoelectric actuator; and the intermediate structure member is made of the same material as the restriction plate.

13. The ink jet head of claim 9, wherein:

the pressure chamber structure member and the piezoelectric actuator are bonded together via an intermediate structure member which is provided to be integral with the piezoelectric actuator by means of an electro-deposition resin; and the intermediate structure member is made of an electrically conductive material and functions as an electro-deposition electrode for electro-deposition of the electro-deposition resin onto the intermediate structure member.

14. A method for producing an ink jet head, the ink jet head comprising: a piezoelectric actuator comprising a piezoelectric layer which expands/contracts in a planar direction perpendicular to a thickness direction according to a direction of an electric field applied in the thickness direction, wherein the expansion/contraction of the piezoelectric layer in the planar direction is converted into a displacement in the thickness direction by a restriction plate for restricting the expansion/contraction on one of surfaces of the piezoelectric layer which are perpendicular to the thickness direction, thereby discharging ink from the pressure chamber to the outside, the method comprising the steps of:

providing a piezoelectric actuator on a substrate;

providing a restriction plate layer on the piezoelectric actuator so as to substantially entirely cover the surface of the piezoelectric actuator;

patterning the restriction plate layer into a predetermined pattern so as to provide a plurality of restriction plates from the restriction plate layer, thereby providing an intermediate product which comprises the piezoelectric actuator and the restriction plates being provided on the substrate;

bonding the intermediate product to a pressure chamber structure member which comprises a plurality of pressure chambers so that the restriction plates are located on the side of the intermediate product which is closer to the pressure chamber structure member and the restriction plates respectively correspond to the pressure chambers; and removing the substrate from the intermediate product on the pressure chamber structure member.

15. The method for producing an ink jet head of claim 14, wherein:

after providing the piezoelectric actuator on the substrate, an electrically insulative layer is provided on the piezoelectric actuator so as to substantially entirely cover the surface of the piezoelectric actuator; and after providing the electrically insulative layer, the restriction plate layer is provided on the electrically insulative layer.

16. The method for producing an ink jet head of claim 14, wherein:

an intermediate structure member is provided from the restriction plate layer simultaneously while providing the restriction plates from the restriction plate layer; and after providing the intermediate structure member, the intermediate product and the pressure chamber structure member are bonded together via the intermediate structure member.

17. The method for producing an ink jet head of claim 16, wherein:

when providing the restriction plate layer, an electrically conductive material is used as a material of the restriction plate layer;

after providing the restriction plates and the intermediate structure member from the restriction plate layer, an electro-deposition resin is electro-deposited onto the intermediate structure member by using the intermediate structure member as an electro-deposition electrode; and after the electro-deposition of the electro-deposition resin, the intermediate product and the pressure chamber structure member are bonded together by the electro-deposition resin on the intermediate structure member.

18. A method for producing an ink jet head, the ink jet head comprising: a piezoelectric layer which expands/contracts in a planar direction perpendicular to a thickness direction according to a direction of an electric field applied in the thickness direction, wherein the expansion/contraction of the piezoelectric layer in the planar direction is converted into a displacement in the thickness direction, thereby discharging ink from the pressure chamber to the outside, the method comprising the steps of:

providing a common electrode on a substrate substantially entirely across the surface of the substrate;

providing a piezoelectric layer on the common electrode substantially entirely across the surface of the common electrode;

providing a separate electrode layer on the piezoelectric layer substantially entirely across the surface of the piezoelectric layer;

patterning the separate electrode layer into a predetermined pattern so as to provide a plurality of separate electrodes from the separate electrode layer; and providing a plurality of pressure chambers in the substrate so that the pressure chambers respectively correspond to the separate electrodes.

19. An ink jet type recording apparatus for performing a recording operation by discharging ink from an ink jet head onto a recording medium, wherein:

the ink jet head comprises: a pressure chamber structure member, the pressure chamber structure member comprising a plurality of pressure chambers which are filled with ink and a plurality of openings respectively for the pressure chambers which are provided along a predetermined surface of the pressure chamber structure member; and a piezoelectric actuator provided on one surface of the pressure chamber structure member along which the openings of the pressure chambers are provided;

the piezoelectric actuator comprises a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction;

each portion of the piezoelectric actuator which corresponds to the opening of one of the pressure chambers and which generally corresponds to a center of the opening is defined as a displacement section, wherein when an electric field for expanding/contracting the piezoelectric layer in the planar direction is applied across a portion of the piezoelectric layer corresponding to the displacement section, the expansion/contraction of the piezoelectric layer in the planar direction is converted to a displacement in the thickness direction, whereby the displacement section is displaced in the thickness direction as a result of the conversion;

each portion of the piezoelectric actuator which corresponds to the opening of one of the pressure chambers and which is in a vicinity of the displacement section is defined as an expansion/contraction section, wherein when an electric field for expanding/contracting the piezoelectric layer in the planar direction is applied across a portion of the piezoelectric layer corresponding to the expansion/contraction section, the expansion/contraction section expands/contracts in the planar direction by the expansion/contraction of the piezoelectric layer in the planar direction; and the ink jet head is configured so that the displacement of the displacement section in the thickness direction is controlled by the expansion/contraction of the expansion/contraction section in the planar direction, so that the displacement of the displacement section in the thickness direction changes a volume of the corresponding pressure chamber, thereby discharging ink from the pressure chamber onto the recording medium.

20. An ink jet type recording apparatus for performing a recording operation by discharging ink from an ink jet head onto a recording medium, wherein:

the ink jet head comprises: a pressure chamber structure member, the pressure chamber structure member comprising a plurality of pressure chambers which are filled with ink and a plurality of openings respectively for the pressure chambers which are provided along a predetermined surface of the pressure chamber structure member; and a piezoelectric actuator provided on one surface of the pressure chamber structure member along which the openings of the pressure chambers are provided;

the piezoelectric actuator comprises: a piezoelectric layer which is provided substantially entirely across one surface of the pressure chamber structure member along which the openings of the pressure chambers are provided and which expands/contracts in a planar direction perpendicular to a thickness direction according to a direction of an electric field applied in the thickness direction; a common electrode provided on one of surfaces of the piezoelectric layer which are perpendicular to the thickness direction thereof; and a separate electrode provided on the other one of the surfaces of the piezoelectric layer which are perpendicular to the thickness direction thereof for producing the electric field of a predetermined direction between the separate electrode and the common electrode;

a restriction plate for restricting expansion/contraction in the planar direction of a portion of the piezoelectric layer on one side thereof which is closer to the pressure chamber structure member is provided in each portion of the piezoelectric actuator which corresponds to the opening of one of the pressure chambers on one surface of the piezoelectric actuator which is closer to the pressure chamber structure member; and the ink jet head is configured so that the expansion/contraction of the piezoelectric layer in the planar direction is converted by the restriction plate into a displacement in the thickness direction thereof to displace in the thickness direction a portion of the piezoelectric actuator which corresponds to the opening of the pressure chamber so as to change a volume of the corresponding pressure chamber, thereby discharging ink from the pressure chamber onto the recording medium.

* * * * *